US005329163A

United States Patent [19]

Satoh et al.

[11] Patent Number: 5,329,163

[45] Date of Patent: Jul. 12, 1994

[54] AUTO-SWITCH FOR POWER WINDOW

[75] Inventors: Hiroshi Satoh, Sakado; Noboru Kamiya, Hasuda; Toru Tanaka, Konosu; Sadayoshi Oshima, Kitamoto; Minoru Mohri, Tokorozawa, all of Japan

[73] Assignee: Toyo Denso Kabushiki Kaisha, Tokyo, Japan

[21] Appl. No.: 809,203

[22] Filed: Dec. 12, 1991

Related U.S. Application Data

[63] Continuation-in-part of Ser. No. 724,453, Jul. 3, 1991, abandoned, which is a continuation of Ser. No. 368,386, filed as PCT/JP87/00581, Aug. 1, 1987, abandoned.

[51] Int. Cl.[5] ..... H01H 21/50

[52] U.S. Cl. ..... 307/10.1; 200/557; 200/1 V; 200/553; 200/558; 200/325

[58] Field of Search ..... 307/10.1; 200/337-339, 200/1 V; 318/266, 239-242, 315, 6 R, 6 B, 6 BB, 12, 61.27

[56] References Cited

U.S. PATENT DOCUMENTS

| | | | |
|---|---|---|---|
| 2,248,362 | 7/1941 | Krieger | 200/6 B |
| 4,376,896 | 3/1983 | Takeda et al. | 307/115 |
| 4,540,965 | 9/1985 | Hattori et al. | 335/259 |
| 4,543,515 | 9/1985 | Suzuki | 318/293 |
| 4,551,660 | 11/1985 | Suzuki | 318/293 |
| 4,584,546 | 4/1986 | Hattori et al. | 335/186 |
| 4,678,975 | 7/1987 | Vrabel et al. | 318/266 |
| 4,709,196 | 11/1987 | Mizuta | 318/282 |
| 4,803,317 | 2/1989 | Sutoh et al. | 200/438 |
| 4,843,195 | 2/1989 | Sato et al. | 200/302.3 |
| 4,843,200 | 6/1989 | Parlatore et al. | 200/553 |
| 4,904,833 | 2/1990 | Sato et al. | 200/557 |

*Primary Examiner*—A. D. Pellinen
*Assistant Examiner*—Aditya Krishman
*Attorney, Agent, or Firm*—Nikaido, Marmelstein Murray & Oram

[57] ABSTRACT

The present invention relates to an auto-switch which is used for a control circuit of a power window for moving automobile window glass up and down using an electric window motor, and has a manual/automatic contact, wherein the auto-switch is operably by a single operating knob. In the auto-state, the auto-switch can mechanically retain the manual/automatic contact at a closed state, and can always reset the operating knob to the neutral position.

14 Claims, 14 Drawing Sheets

AUTO-SWITCH FOR POWER WINDOW

This is a contunuation of application Ser. No. 07/724,453 filed Jul. 3, 1991, now abandoned, and which is a continuation of Ser. No. 07/368,386 filed as PCT/JP87/00581, Aug. 1, 1987, now abandoned.

FIELD OF THE INVENTION

This invitation relates to a switch for use in power window for moving a window glass up or down by rotating an electric window motor forward or backward, and more particularly to an auto-switch which, when it is closed once, can rotate the window motor until the window glass reaches its full-open or full-closed position even if the operator's hand is lifted off the switch.

BACKGROUND OF THE INVENTION

An example of the construction of a prior art switch for use in a power window is shown in FIG. 22. This switch comprises a long common $C_c$ on a power supply side serving as a fixed contact, a pair of manual operation contacts (which are referred to simply as "manual contacts") $C_M$ provided in juxtaposition with both ends thereof, and a pair of shortest auto-operation contacts (which are referred to simply as "auto-contacts") $C_A$ provided in juxtaposition with the end of each of the manual contacts $C_M$. A sliding contacts $C_S$ attached to an operating knob $K_b$ is sliding disposed on the intermediate portion of the power supply side common $C_c$ so that the contact $C_S$ may be brought by the knob $K_b$ into contact with either one of the left and right hand manual contacts $C_M$ or with both of either one of the manual contacts $C_M$ and either one of the auto-contacts $C_A$. The operating knob $K_b$ can be used to change the upward movement of the window glass over to downward movement or vice versa depending on the direction of movement of the knob. For the sake of convenience of the following description, in this drawing, the counter-clockwise swing of the knob shall be referred to as "up-side" swing, and the clockwise swing thereof as "down-side" swing. Further, the knob $K_b$ is biased by a spring to return to its neutral position, if the operator's hand is removed from the knob which is in swinging condition. The left and right hand manual contacts $C_M$ are connected through relays $R_{UP}$ and $R_{DWN}$, respectively, which are normally grounded, with a window motor M. The left and right hand auto-contacts $C_A$ are connected through an auto-condition retaining circuit A.R.C with the relays $R_{UP}$ and $R_{DWN}$, respectively.

When the knob $K_b$ is moved to contact the sliding contact $C_S$ with either one of the left and right hand manual contacts $C_M$, the switch will assume either a manual-up position $M_{UP}$ or a manual-down position $M_{DWN}$. Only while the knob $K_b$ is held at this position, either the relay $R_{UP}$ or the relay $R_{DWN}$ is energized so as to connect it with the power supply to rotate the window motor M forward or backward so that upward or downward movement of the window glass can be manually conducted.

When the knob $K_b$ is moved further to contact the sliding contact $C_S$ with either one of the left and right hand manual contacts $C_M$ and either one of the left and right hand auto-switches $C_A$, the switch will assume either an auto-up position $AT_{UP}$ or an auto-down position $AT_{DWN}$ so that, even when the operator's hand is removed from the knob $K_b$ to return it to its neutral position N, electric current flowing through either one of the auto-switches $C_A$ Will allow the auto-condition retaining circuit A.R.C to assume auto-operating condition thus holding either the relay $R_{UP}$ or the relay $R_{DWN}$ in operative condition. Consequently, the window motor M is allowed to rotate continuously, When the window glass is opened or shut to its full extent shortly, the window motor M is stopped, and the sensor which detects the stopping of it will release the auto-condition, thereby turning off electricity to the window motor M. Thus, since the arrangement is made such that depending on the amount of movement of the operating knob either the manual operation or the auto-operation can be re-elected as desired, it is only necessary to provide only one piece of the knob so that the structure of the switch can be simplified and also it can be operated easily.

However, when the relay $R_{UP}$ is held in auto-condition, for example, if the knob $K_b$, which has been returned to its neutral position N, is moved to the manual-down position $M_{DWN}$ on the opposite side (reverse manual position), then the auto-condition retaining circuit A.R.C. will release the auto-up condition, and the relay $R_{DWN}$ is rendered operative after a predetermined time.

An example of the auto-switch adapted to hold the window glass in the auto-condition by means of such a relay is described also in U.S. Pat. No. 4,709,196.

Further, in the following description, upward and downward movements of the window glass by such a manual operation are referred to as manual-up and manual down, respectively, and upward and downward movements of the window glass by such auto-operations as auto-up and auto-down, respectively.

This auto-switch, which enables both the manual operation and the auto-operations to be conducted, is mounted on a door of a motor vehicle by a driver seat, while a manual switch which can be actuated only by manual operation is mounted on each of the remaining doors. As the manual switch of the kind specified above, a reverse switch is sometimes used, which comprises a pair of V-shaped swing contact plates each having a normally-open movable contact and a normally-closed movable contact provided on both ends thereof, the arrangement being made such that either one of the swing contact plates is inclined reversely by swinging the knob, depending on the direction of swing thereof (such a manual switch is described, for example, in U.S. Pat. No. 4,803,317).

Incidentally, since the auto-switch utilizing the above-mentioned relay circuit requires a comparatively large space for mounting the relays $R_{UP}$ and $R_{DWN}$ on the up and down sides thereof, it is difficult to assemble these relays integrally in the switch for a power window fitted to a door of a motor vehicle. Therefore, the switch and the circuit/relay must be mounted separately, thus increasing the number of attaching operations to the doors of the motor vehicle, and also increasing the restrictions in terms of space for mounting. Moreover, the separate mounting resulted in increases in the number of parts and the weight, thus increasing the cost. For this reason, it has been desired strongly to make the auto-switch as light- weight and compact as possible by forming it in such a construction which needs not use such relays.

Further, auto-switches which use a solenoid in place of relays are shown in, for example, U.S. Pat. Nos. 4,376,896 and 4,540,965, etc. However, all of these autoswitched are arranged to hold an operating knob, which is swung to an auto-position and held in a swinging condition, in auto-condition. In order to release the auto-condition at any desired position, a strong force must be applied to the knob to move it back to its neutral position and open the contacts compulsorily. Therefore, it was impossible to operate the knob for releasing the auto-condition at a desired position with the same feeling as that in operating it in the normal operation.

Accordingly, the present invention has for its principal object to provide an auto-switch which is capable of stopping the rotation of the window motor in the auto-condition at any desired position by operating the knob with the same feeling as that in operating it in the normal operation so that the operability of the knob is enhanced.

SUMMARY OF THE INVENTION

To achieve the above-mentioned object, the auto-switch for use in a power window uses a reverse switch type construction comprising a pair of generally V-shaped first and second swing contact plates that are inclined in opposite directions with each other when an operating knob is located at its neutral position, and a pair of first and second swing members disposed on both sides of a single operating knob in the direction of a shaft for selectively inclining either one of the swing contact plates reversely, the arrangement being made such that either one of the swing members is selectively engaged by engaging means of the knob and swung together with it, and in auto-condition the swing member engaged and interlocked with the engaging means is mechanically held by locking means in the auto-condition, and the knob can be returned independently to its neutral position.

Since such an arrangement enables both the manual and auto-operations to be conducted by means of a single operating knob, the operability thereof can be enhanced and the occurrence of wrong operation can be prevented. Moreover, since the knob can be returned to its neutral position even in the auto-condition, when, for example, the first swing member in swinging condition is held in the auto-condition and the corresponding first swing contact plate is inclined reversely with its normally-open movable contact connected with the fixed contact on the power supply side, if the knob is swung to the reverse manual position so as to allow the second swing member to be engaged with the knob and swung together with it, then the second swing contact plate is inclined reversely to permit its normally-open movable contact to be connected with the fixed contact on the power supply side so that both poles of the window motor assume the Hi-Hi condition, and the rotation of the motor is stopped. Therefore, the rotation of the window-motor in the auto-condition can be stopped immediately with the same feeling and operation of the knob as those in the normal operation, and also since the knob is then returned to its neutral position, the operability of the knob is enhanced.

Further, since the electrical connection between the normally-open movable contact and the fixed contact on the power supply side can be mechanically held in the auto-condition, the whole of the auto-switch can be formed in a compact unit. Thus, it becomes possible to reduce the number of operations for mounting the switch on a door of a motor vehicle, reduce the restrictions on the space for mounting the switch, and also reduce the weight and cost thereof.

The engaging means can be formed simply by engaging portions formed on the sides of the operating knob on which the first and second swing members, respectively, are mounted, the engaging portions being located symmetrically on the opposite sides of the shaft, and also the portions of the first and second swing members, respectively, with which the corresponding engaging portions are selectively engaged depending on the direction of swing of the knob.

Further, as the first and second swing members, members or parts which are identical in shape can be used by locating them with their respective stopper portions facing reversely relative to the shaft. Therefore, there is no need for forming the first and second swing members, respectively, separately for exclusive use for the left hand side ones and for the right hand side ones, and so common use of the parts can be made thereby reducing the total number of parts of the switch.

Further, if the means for returning the knob to its neutral position is formed by a thrusting member provided at the leading end of the knob so as to be moved freely by the resilient means forward and backward, and a sloping guide of a generally V-shaped section formed on the base portion of the switch, with which the thrusting member can be brought into pressure contact, and also the means for returning the first and second swing members, respectively, to their neutral positions are formed by thrusting members provided at their leading ends and having a similar shape to that of the knob, and a first swing contact plate and a second swing contact plate, respectively, with which the thrusting members can be brought into pressure contact, the respective returning means can be rendered operative independently to enable each of the knob, the first and second swing members to be returned independently to its neutral position. Therefore, the knob can be returned alone to its neutral position while the swing member is mechanically held in the auto condition, and then the swing member which is released from the auto-condition can be returned alone to its neutral position.

Further, the locking means comprises sliding members connected to the corresponding swing members, respectively, and which can be moved rectilinearly, and a locking arm disposed in the direction at right angles to the sliding members and which is engageable with the engaging portions formed on the sliding members. The sliding members are engaged or interlocked with the corresponding swing members, respectively, when the knob is operated to the manual position or the auto-position, and the amount of movement of each of the sliding members varies with the angle of swing of the associated swing member. The engaging portion of each of the sliding members can be arranged such that it is disengaged from the locking arm, which is pushed by the solenoid towards the sliding member, at the manual position, and it is engaged with the locking arm at the auto-position. By virtue of such arrangement, the locking arm becomes engageable with each of the sliding members in the direction at right angles to the latter, the sliding member can be locked by the locking arm with certainty without subjecting to much influence of the operational accuracy of the locking arm, etc.

By connecting each of the sliding members to the corresponding swing member, when the swing member is returned to its neutral position, the sliding member is returned to its neutral position together with the swing member by the returning force of the latter. Therefore, independent means for returning each sliding member can be omitted.

Further, if one end of the locking arm is used as a fulcrum for vertical swing, and the other end thereof as a locking portion, and also the fulcrum for swing, the locking portion and the pushing portion of the solenoid are located substantially collinearly, either one of the sliding members can be locked with more certainty. Further, the loss of forces which occurs during locking is reduced so that the size of the solenoid can be reduced, thereby reducing the power consumption. Furthermore, by putting the locking arm between a pair of guide portions, it can be swung accurately to enable the locking operation thereof to be made with more certainty.

Moreover, if the engaging portion of the sliding member is composed of a high step and a low step, then the leading end of the locking arm can be dropped from a high step to the low step and becomes engageable with the engaging position, and as a result the sliding member can be locked by the locking arm with more certainty. Furthermore, in the case of a design specification which enables both auto-up and auto-down operations to be made, a pair of sliding members are mounted in parallel with each other and connected to the corresponding swing members, respectively. By such an arrangement, change of the specification from combined auto-up-and-down type to either auto-up type or auto-down type or vice versa can be made easily. If the sliding members are mounted outside of the first and second swing contact plates, respectively, the transverse width of the swinging portion which is comprised of the knob, the first and second swing members, and the first and second contact plates can be reduced, and consequently the whole of the switch can be made compact.

Further, if the locking arm is disposed in such a direction as to intersect the sliding members, the end portion of the locking arm are located so as to intersect the sliding members, and also the central part thereof is arranged to be pushed by the solenoid, then it is only necessary to use one piece each of locking arm and solenoid, which contributes to reduction in size and weight of the switch. Moreover, even when one of the sliding members is omitted by change in the specification, the locking arm and the solenoid can be used as they are, so that change in the specification can be dealt with flexibly.

Furthermore, in case an auto-switch which is capable of conducting either auto-down operation or which is auto-up operation is used, if it comprises a compulsory release mechanism for compulsorily releasing the auto-condition by operating the knob to the reverse auto-position when one of the swing members is in the auto-condition, then it is possible to prevent such a situation as both the down-side and the up-side are mistakenly held in the auto-condition at the same time, even though the switch is of the type wherein the knob which has been returned to its neutral position in the auto-condition can be operated to the reverse auto-position.

This compulsory auto-condition release mechanism comprises releasing portions formed on the knob, stopper portions formed on the swing members with each of which the corresponding releasing portion is brought into contact, and slopes each formed between the high and low steps of each of the sliding members so as to connect them, and the releasing portions are provided one piece on each of the sides of the knob adjacent to the swing members and at locations opposite to the engaging portion on the same side of the knob relative to the shaft. The arrangement is made such that when the knob, which is either in the auto-up position or in the auto-down position, is swung to the reverse manual position the corresponding releasing portion is brought into contact with the stopper portion held in the auto-condition, and when the knob is swung further to the reverse auto-position the swing member held in the auto-condition can be swung by the releasing portion, with which the stopper portion is held in contact, to its neutral position together with the knob. Since a strong force is applied to the sliding member held in the auto-condition to move it to its neutral position, the leading end of the locking-arm which is dropped on the low step is pushed along the slope up onto the high step to thereby unlock it, so that the auto-condition can be released compulsorily.

BRIEF DESCRIPTION OF THE DRAWINGS

FIG. 1 through 16 show one embodiment of the present invention in which:

FIG. 1 is a plan view showing the whole of a master switch, to which the present invention is applied;

FIG. 2 is a schematic circuit diagram of the master switch;

FIG. 3 is an exploded perspective view of the master switch;

FIG. 4 is an exploded perspective view of principal parts of the embodiment;

FIG. 5 is a sectional view taken along line V—V in FIG. 1;

FIGS. 6(*a*) and 6(*b*) are explanatory views showing the operation thereof;

FIGS. 7(*a*) to 7(*b*) are schematic views for explaining the behavior of swing contact plates, respectively, for moving the window glass up and down in response to the operation of an operating knob;

FIGS. 8 through 13 are explanatory views showing the operations of a locking means;

FIG. 14 is a circuit diagram of the embodiment;

FIGS. 15 and 16 are operational explanatory views showing the relationship between the operation of the operating knob and the change-over of contacts;

DESCRIPTION OF THE PREFERRED EMBODIMENTS

Figure 1:
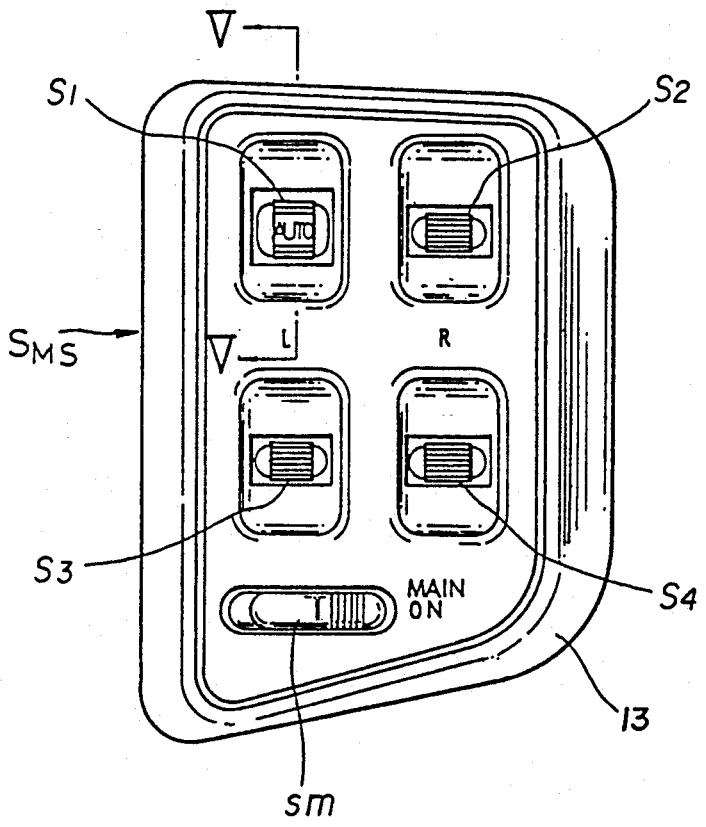
Figure 2:
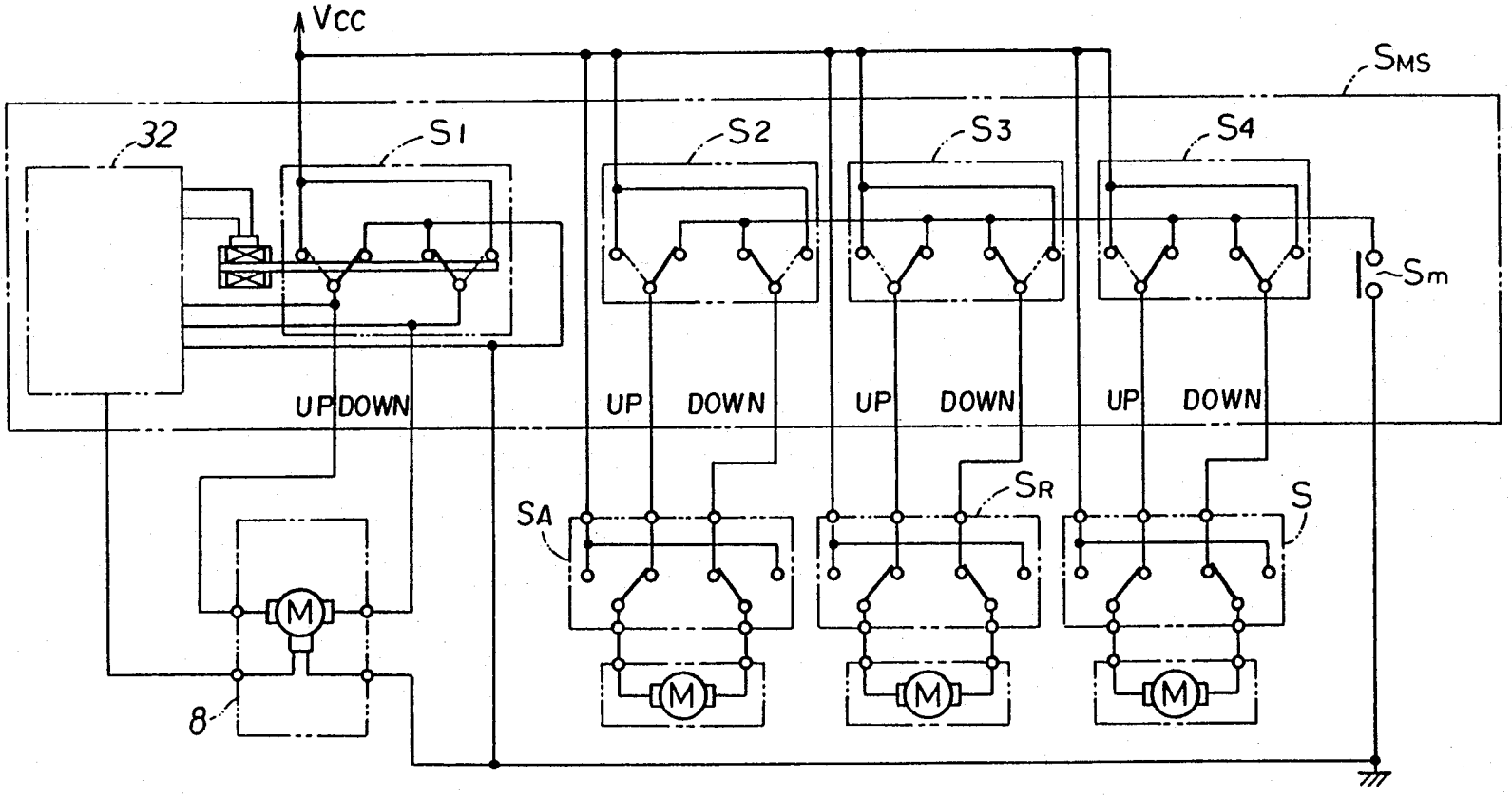

The present invention will now be described below by way of one embodiment thereof with reference to FIGS. 1 through 17. FIG. 1 is a plan view showing the configuration of a master switch $S_{MS}$ which is mounted on a door of the driver seat side for controlling upward and downward movements of the glass of a power window for motor vehicle (not shown in the drawing), and to which the present invention is applied. FIG. 2 is a circuit diagram of all the switches for the power window mounted inside of the room of the vehicle, which shows the relationship between other manual switches $S_A$, $S_R$ and $S_L$ mounted on a door on the assistant driver seat side and those on the right and left rear seat sides, respectively, and the master switch $S_{MS}$.

As is apparent from these drawings, the master switch $S_{MS}$ comprises a main switch $S_m$ for applying and breaking a power supply, a driver switch $S_1$ for moving up and down the window glass on the driver seat side, a sub-switch $S_2$ for moving up and down the window glass on the assistant driver side, and sub-switches $S_3$ and $S_4$ having a similar construction for moving up and down the left and right window glasses on the rear left and right seat sides. Out of these switches, the main switch $S_m$ is arranged to open and close the ground side of all the sub-switches excluding the driver switch $S_1$, and is provided only on the master switch $S_{MS}$ so that the concentrated control of upward and downward movements of all the window glasses can be done by the driver.

The driver switch $S_1$ comprises a contact for driving a window motor M (refer to FIG. 2), and an auto-condition retaining circuit which will be mentioned later, and has both functions for manual operation, which requires the switch to be closed on by a finger of the operator while moving the window glass up or down, and for auto-operation, by which when the switch is closed once, the window glass is moved upward or downward by a predetermined amount even if the operator's finger is removed from the switch. Further, the driver switch $S_1$ can be actuated irrespective of the state of the main switch $S_m$.

The sub-switched $S_2$ through $S_4$ are provided for moving up and down the other window glasses than that on the driver seat side through remote control by the driver when the main switch $S_m$ connected in series with the sub-switches is turned on, That is, each of the sub-switches $S_2$ through $S_4$ conducts only manual operation which moves its associated window glass up and down by actuating its associated window motor M individually without operating each of the manual switches $S_A$, $S_R$ and $S_L$ (Refer to FIG. 2).

Further, the master switch $S_{MS}$, the manual switches $S_A$, $S_R$ and $S_{ML}$ well as the sub-switches $S_2$ through $S_4$ are all constructed in the form of reverse switches so that the operating knob (which will be described later) can be manipulated by nearly the same operating force.

Figure 3:
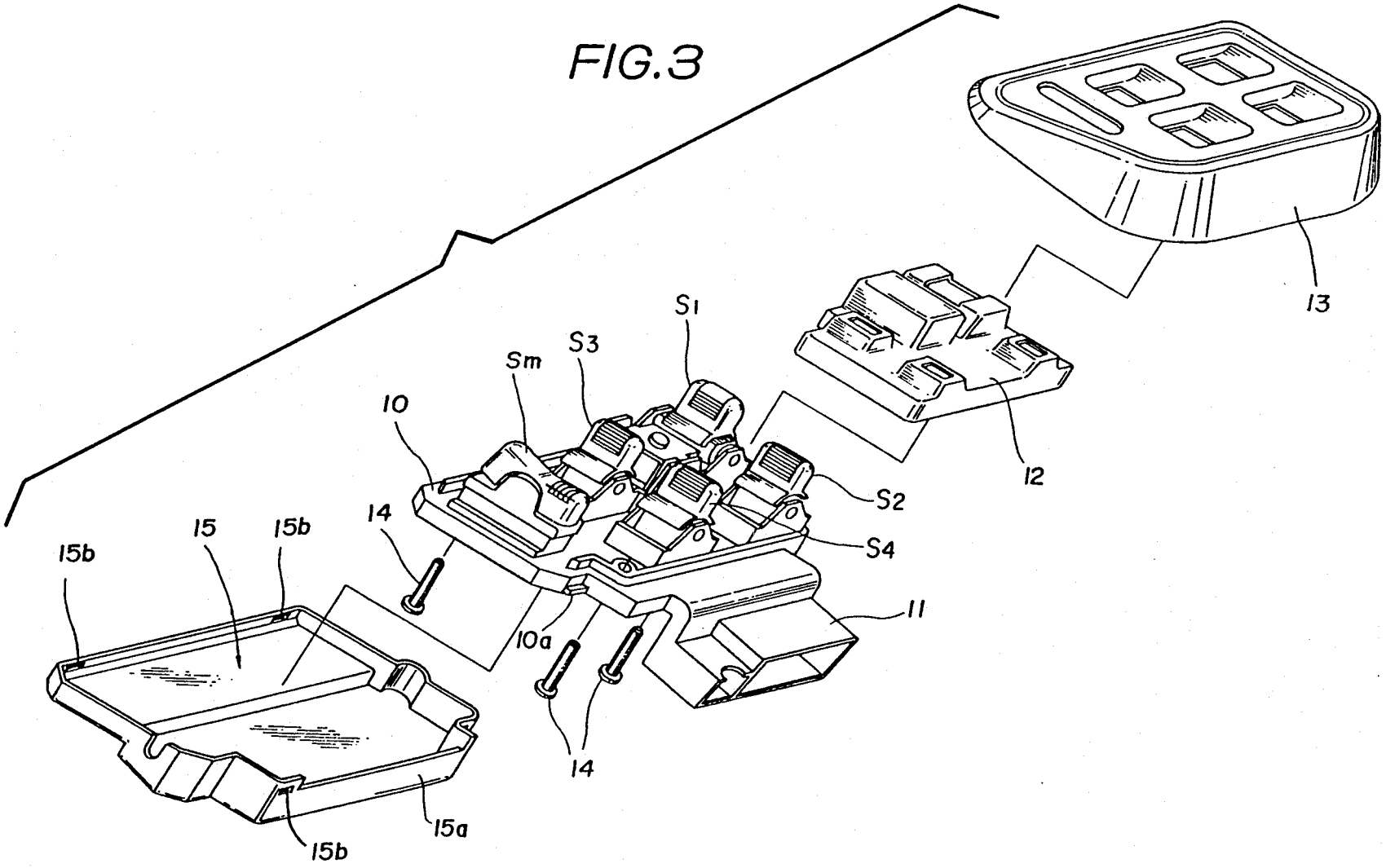

FIG. 3 is an exploded, perspective view showing the construction of the master switch $S_{MS}$ wherein the driver switch $S_1$, the sub-switches $S_2$ through $S_4$, and the main switch $S_m$ are mounted on a plastic base plate 10. The base plate 10 has electrode plates (which will be described later) embedded in separate two large, i.e. upper and lower layers, the connection end of which is extended into a coupler case 11 formed integrally with the base plate 10 on one side thereof.

The upper surface of the base plate 10 is covered by a plastic cover 13 through a seal cover 12 made of rubber, and fastened by means of screws 14 to the covers 12 and 13 integrally.

The seal cover 12 serves to waterproof the contacts of the switches and has openings of rather small size formed therein through which operating knobs of the switches project.

The cover 13 has openings formed therein, which are of such sizes as to allow the top of the knobs to project and enable the knobs to be swung. Reference numeral 15 denotes a cover to be fitted to the back of the base plate 10. The cover 15 has a proper number of holes **15*b* formed in the vertical wall 15*a* extending along the periphery of the cover 15. The cover 15 is fitted to the base plate 10 by fitting engaging pieces 10*a*, which are formed on the peripheral portion of the base plate 10 and the number of which corresponds to that of the holes 15*b*, into the latter so as to cover component parts of a circuit (which will be described later) provided on the back of the base plate 10**.

Next, the details of the construction of the driver switch $S_1$ is described. As can be seen from showing the driver switch $S_1$ in exploded and partially cut-away condition, the base plate 10 (FIG. 3) has a vertical wall 16 formed integrally therewith on the front surface thereof. The vertical wall 16 has a pair of shaft supports **16*a* and a pair of solenoid supports 16*b* formed on the opposite sides thereof. Further, the vertical wall 16 has a vertical partition wall 16*c* formed integrally therewith and extending transversely between the shaft supports 16*a* and the solenoid supports 16*b* so as to define two chambers, i.e. a chamber "A" in which a switch mechanism is accommodated, and a chamber "B" in which a locking means for holding the auto-condition is accommodated. Each of the shaft support 16*a* has a shaft insertion hole 16*d* formed therein, and each of the solenoid supports 16*b* has an engaging hole 16*e* formed therein. However, in case a high dimensional accuracy is required for the vertical wall 16, it is possible to form the vertical wall separately from the base plate 10** in such a shape as can be used commonly with the portion forming the sub-switches $S_2$ through $S_4$.

Figure 5:
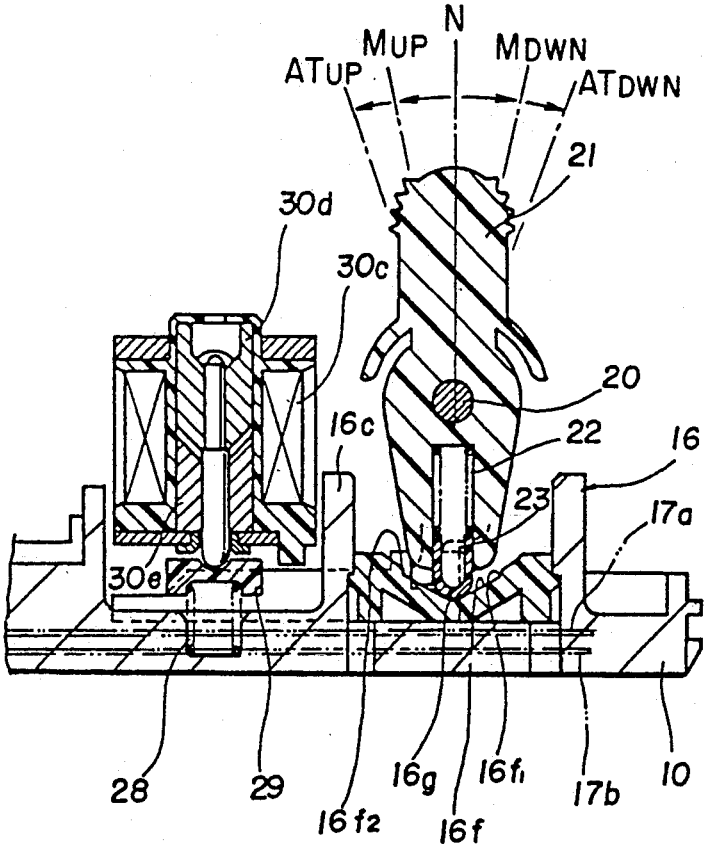

As is apparent from FIG. 5 showing the section of the master switch taken along line V—V in FIG. 1, a sloping guide **16*f*, which is a generally V-shaped separate part, is fitted to the bottom of the chamber A. The sloping guide 16*f*** has steps formed on the upper parts of both slopes thereof so as to define manual stoppers $16f_1$ and $16f_2$, respectively.

In the vicinity of a bent portion **16*g* forming the lowermost part of the sloping guide 16*f*, there are provided fulcrum electrodes 17*c* and 17*d* which rise from electrode plates 17*a* and 17*b*, respectively, embedded in the base plate 10, and project into the space enclosed by the vertical wall 16. The fulcrum electrodes 17*c* and 17*d* are each formed by a member bifurcated at its leading end, and located at symmetrical positions slightly spaced apart from the bent portion 16*g*, Generally V-shaped swing contact plates 18 and 19, which are identical in shape, are supported symmetrically by the fulcrum electrodes 17*c* and 17*d*, respectively. The swing contact plate 18 and 19 have movable contacts 18*a*, 18*b* and 19*a*, 19*b***, respectively, formed at their both ends.

Figure 6A:
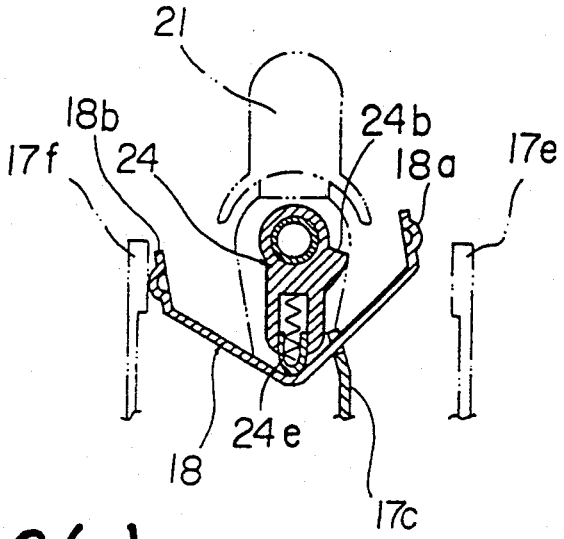
Figure 6B:
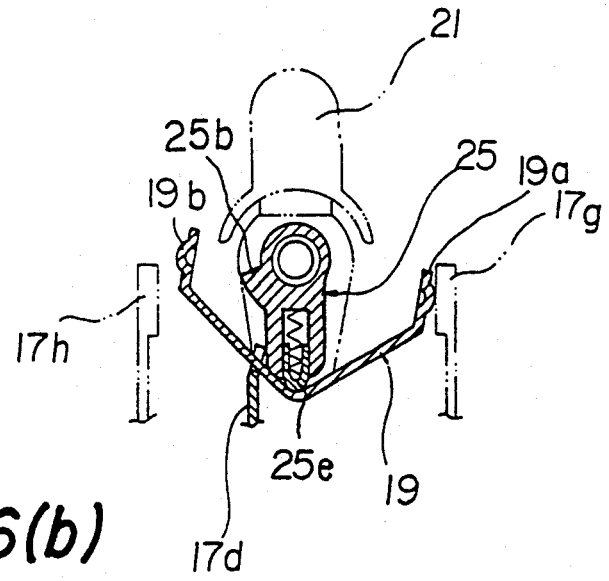

FIGS. 6(*a*) and 6(*b*) show separately the sections of swing contact plates 18 and 19, respectively, in neutral condition. As is apparent from these figures, since the swing contact plates 18 and 19 are supported by the fulcrum electrodes **17*c* and 17*d*, respectively, at symmetrical positions slightly offset from their bent portions 18*c* and 19*c*, respectively, which are intermediate, lowermost portions thereof, the swing contact plate 18 and 19** are normally inclined in opposite directions with each other.

Further, fixed contact **17*e* through 17*h* are formed on the loading ends of the portions which extend vertically from branched portions of the electrode plates 17*a* and 17*b*, respectively. As can be seen from FIG. 4, these fixed contacts 17*e* through 17*h* are located in pairs along the surface of the partition wall 16*c* and the inner surface of the vertical wall 16 located opposite to the partition wall 16*c*. The arrangement can be made, for example, such that out of these fixed contacts 17***e* through 17*h*, the fixed contacts 17*e* and 17*h* are connected with the power supply, the fixed contacts 17*f* and 17*g* are grounded, the fixed contact 17*h* is used as a down-side contact for moving the window glass down, and the fixed contact 17*e* as an up-contact for moving the window glass up. The following description is made based on this arrangement of the contacts. The fixed contacts 17*e* and 17*h* on the power supply side are contacts for combined use for the manual and auto-operations.

A shaft 20 is passed through the shaft insertion hole 16*d*, and an operating knob 21 is supported by the shaft 20 so as to be turned freely.

The operating knob 21 has a shaft insertion hole 21*a* formed therein, and an engaging portion 21*b* and a releasing portion 21*c* formed on one side thereof. The engaging portion 21*b* and the releasing portion 21*c* are both formed at the two ends of the flange-shaped portion which extends from one side of the knob 21 where one end of the opening of the hole 21*a* is formed to the other side in the longitudinal direction of the shaft 20 in such a way as to surround the shaft insertion hole 21*a*. The engaging portion 21*b* and the releasing portion 21*c* are located opposite to each other about the shaft insertion hole 21*a*. The engaging portion 21*b* is located closer to the leading end side (or to the side of the swing contact plates 18 and 19) of the operating knob 21 than the releasing portion 21*c*. The engaging portion 21*b* and the releasing portion 21*c* are adapted to be engaged with and swung together with one of the swing members, which will be mentioned later, when the operating knob 21 is swung and form a part of each of the engaging means and the compulsory auto-condition release mechanism, respectively, in the invention of this application. Further, the operating knob 21 has also an engaging portion 21*a* and a releasing portion 21*e* formed on the opposite side thereof and in symmetrical relationship with the engaging portion 21*b* and the releasing portion 21*c* relative to the vertical axis passing through the center thereof at the neutral position and having the same functions as those of the latter (Refer to FIGS. 8 to 13). By providing the engaging portions 21*b* and 21*d* on both sides of the operating knob 21 at right angles to the longitudinal direction of the shaft 20 in such a symmetrical relationship, the engaging means of the swing members which will be described later can be formal easily.

Further, provided at the lower end of the operating knob 21 is a pin 23 which is biased by a spring 22 in the direction of projection so that it can be projected and retracted freely. The pin 23 is located on the sloping guide 16*f* such that it can be slidable moved on the latter.

As shown in FIG. 5, the knob 21 is swingable about the shaft 20 and can be changed over either to the up-side or to the down-side, depending on the direction of the swing thereof. Further, either manual operation or auto-operation can be selected depending on the angle of swing in each swing direction. Stating in brief, when the operating knob 21 is swung clockwise from its neutral position N by a predetermined angle, the switch will assume a manual-down position $M_{DWN}$, and when it is swung further, the switch will assume an auto-down position $AT_{DWN}$. While when the knob 21 is swung counterclockwise, the switch will assume a manual-up position $M_{UP}$, and when the knob 21 is swung further, the switch will assume an auto-up position $AT_{UP}$, in like manner.

The operating knob 21 has the pin 23 mounted on the leading end thereof and which is biased by the spring 22 in the direction of projection so that it can be projected and retracted freely. When this pin 23 is slidably moved on the sloping guide 16*f* at its manual-up position or manual-down position, it strikes against either the manual stopper $16f_1$, or the manual stopper $16f_2$ and is prevented from sliding movement. When a stopper force is applied to the operating knob 21, the pin 23 will ride across either the manual stopper $16f_1$ or the manual stopper $16f_2$, the switch will assume either the auto-up position or the auto-down position. Further, when the operator releases his hand from the knob 21 after it has been swung to one of the auto-positions ($AT_{UP}$ or $AT_{DWN}$), the knob 21 is automatically returned to its neutral position N by the reaction force of the spring 22 which urges the pin 23 against the sloping guide 16*f*.

Figure 4:
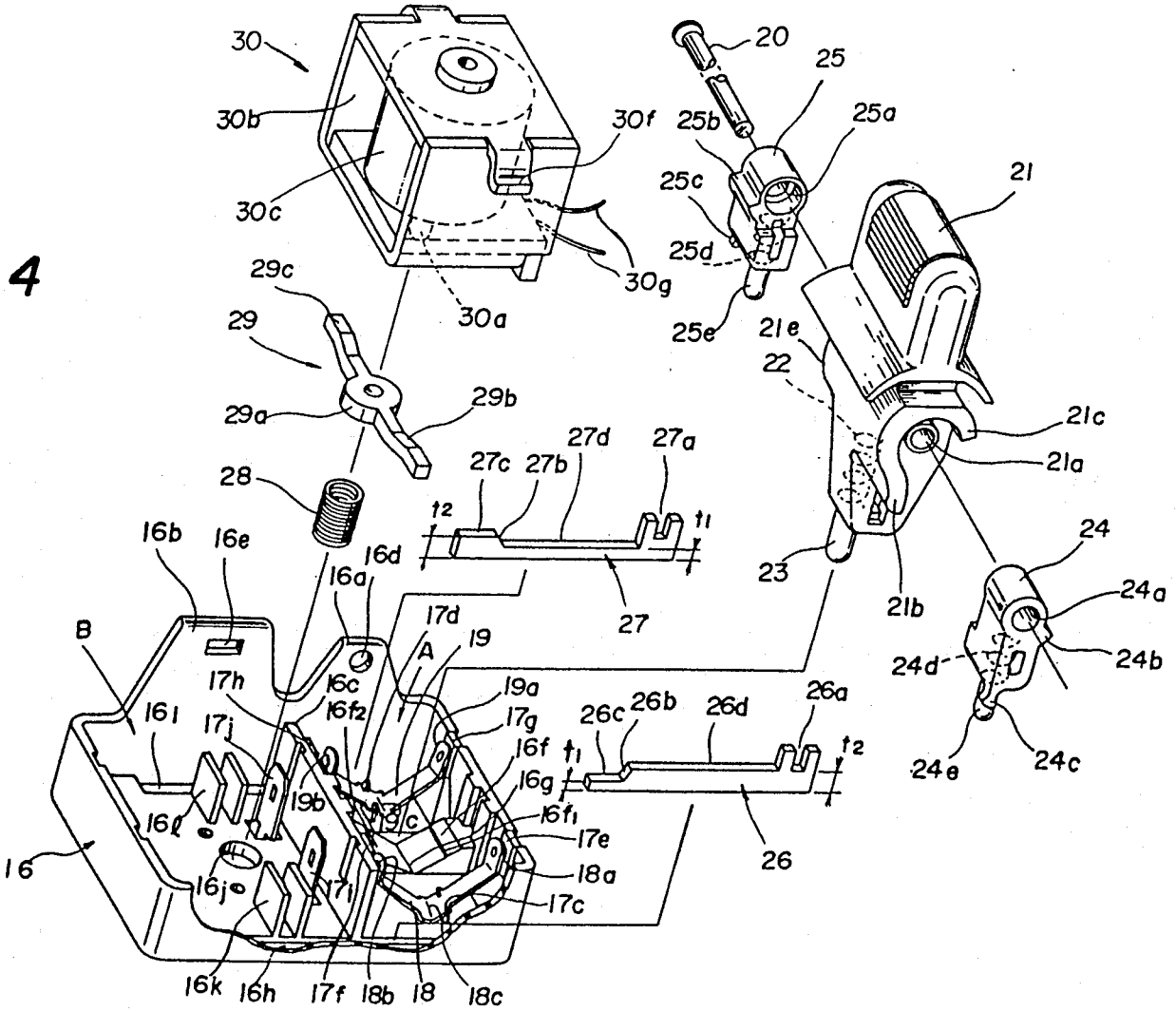

As is apparent from FIG. 4, the shaft 20 passes through the knob 21, and a first swing member 24 and a second swing member 25 are swingably supported by the shaft 20. The first and second swing members 24 and 25 are located adjacent to both sides of the knob 21.

The first swing member 24 has a shaft insertion hole 24*a* formed therein and is supported by the shaft 20 coaxially with the knob 21 by inserting the shaft 20 through the hole 24*a*. Only when the operating knob 21 is swung counterclockwise or to the up-side, the engaging portion 21*b* is engageable with one side of the first swing member 24 so that the first swing member 24 can be engaged or interlocked with the knob 21 and swung together therewith to the up-side. The portion of the first swing member 24 which is engageable with the engaging portion 21*b* forms a part of the engaging means in the invention of this application. Further, the first swing member 24 has also a stopper portion 24*b* formed integrally therewith at a position where it can be brought into contact with the releasing portion 21*c* and on the opposite side of the portion of the first swing member 24, with which the engaging portion 21*b* is engageable, relative to the shaft insertion hole 24*a*. The first swing member 24 forms a part of the compulsory auto-condition release mechanism together with the releasing portion 21*c*. Even when the knob 21 is turned from its neutral position in the clockwise direction (or towards the manual-down position $M_{DWN}$), the first swing member 24 is not engaged with the releasing portion 21*c*, but is engaged with the latter only when the subsequent compulsory auto-condition release is made as will be described in detail latter. The first swing member 24 has a joint portion 24*c* formed integrally therewith at the lower end thereof so as to project downward, and has also a pin 24*e* provided at the leading end thereof and which is biased by a spring 24*d* in the direction of projection so as to freely project from and retract into the leading end thereof. The pin 24*e* is arranged to be slidably movable on the swing contact plate 18 while it is kept in pressure contact therewith.

The second swing member 25 is identical in shape to the first swing member 24, but is located reversely to the latter. The second swing member 25 has a shaft insertion hole 25*a* formed therein, a stopper portion 25*b* and a joint portion 25*c* formed integrally therewith, and also includes a spring 25*d* and a pin 25*e*. Therefore, the second swing member 25 is located symmetrically to the first swing member 24 about the shaft 20 with the stopper portions 24*b* and 25*b* facing reversely. The engaging portion 21*d* and the releasing portion 21*e* (FIGS. 8 through 13) of the knob 21 are also located opposite to the engaging portion 21*b* and the releasing portion 21*c* formed so as to be associated with the first swing member 24. When the knob 21 is swung clockwise or to the down-side, the second swing member 25 is engaged with the engaging portion 21*d* of the knob 21 and swingable together with it. To the contrary, when the knob 21 is swung counterclockwise or to the up-side, the second swing member 25 is not engaged with the engaging portion 21*d* of the knob 21. Further, the compulsory auto-condition release mechanism formed by the releasing portion 21*e* of the knob 21 and the stopper portion 25*b* of the second swing member 25 fulfills the same function as that of the mechanism on the side of the first swing member 24.

The first and second swing members 24 and 25 are identical in shape and assembled with the knob 21 with the stopper portions 24*b* and 25*b* oriented reversely, when the knob 21 is located at its neutral position and it is economical to use them, because common use by them can be made.

Figure 7A:
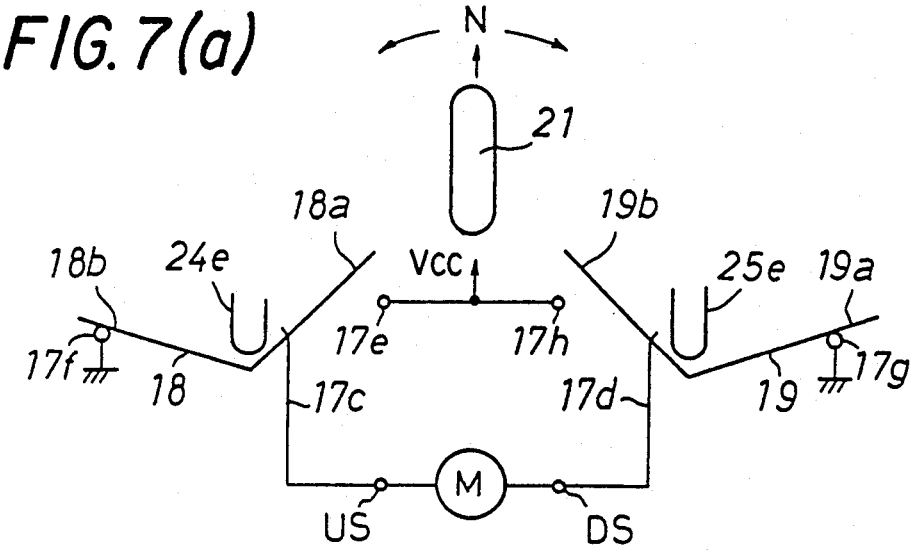
Figure 7B:
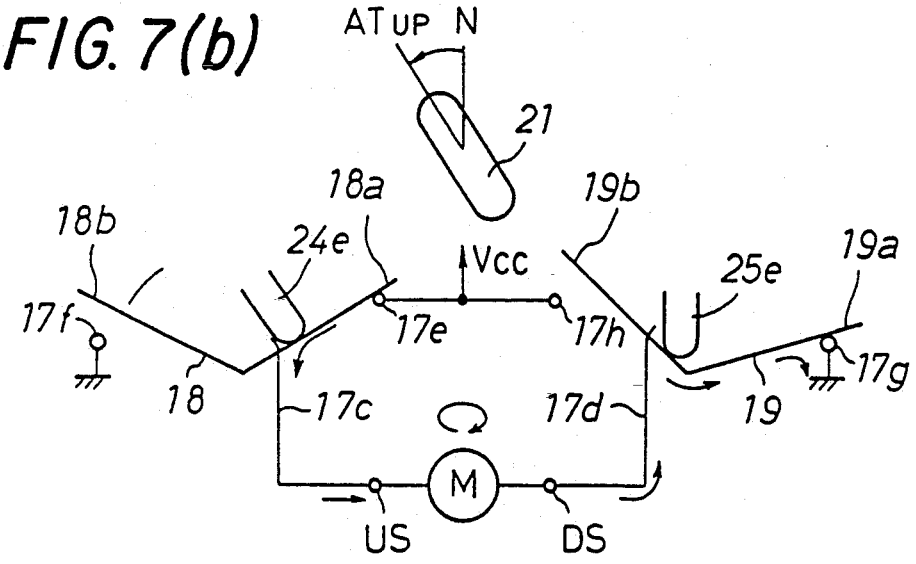
Figure 7C:
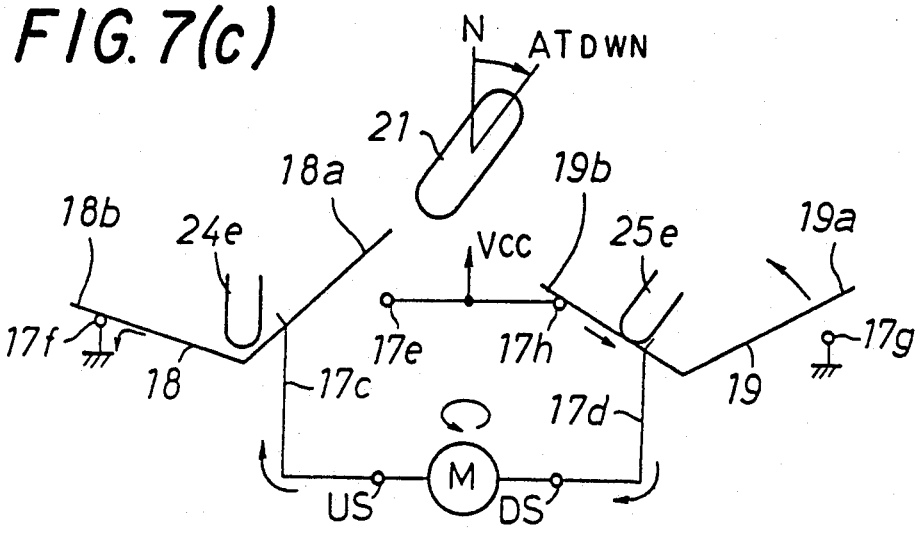

FIGS. 6(*a*) and 6(*b*) show conditions of each of the swing members and each of the swing contact plates when the knob 21 is located at its neutral position. The first and second swing members 24 and 25 are illustrated in FIGS. 6(*a*) and 6(*b*) respectively, when viewed in the direction shown in FIG. 4. Further, FIGS. 7(*a*), 7(*b*) and 7(*c*) are schematic views showing the connections of both the swing contact plates 18 and 19 with a window motor M. The fulcrum electrode 17*c* is connected with a terminal US which is one of both pole terminals of the window motor M, while the fulcrum electrode 17*d* is connected with a terminal DS. FIG. 7 (*a*) shows the behavior of the swing contact plates when the knob 21 is in the neutral condition, FIG. 7(*b*) shows that when the knob 21 is swung to the up-side, and FIG. 7(*c*) shows that when the knob 21 is turned to the down-side.

In FIGS. 6(*a*) and 6(*b*) the swing members 24 and 25 stand upright and are located on the bent portions 18*c* and 19*c* of the swing contact plates 18 and 19, respectively. At that time, the swing contact plates 18 and 19 are inclined in opposite direction to each other. Regarding the swing contact plate 18, the movable contact 18*b* is in contact with the fixed contact 17*f* to thereby form a normally-closed contact, while on the side of swing contact plate 19, the movable contact 19*a* is in contact with the fixed contact 17*g* to thereby form a normally-closed contact. Further, the movable contacts 18*a* and 19*b* form normally-open contacts. When the operating knob 21 is swung either in the clockwise direction or in the counterclockwise direction, either the swing member 24 or 25 is swung selectively and integrally with the knob 21 so that either one of the swing contact plates 18 and 19 is selectively inclined reversely.

When the knob 21 is swung in the clockwise direction (or to the down-side), for example, as shown in FIG. 7(*c*), only the second swing member 25 is swung together with the knob 21 so that the normally-open movable contact 19*b* is brought into contact with the fixed contact 17*h* which is connected with the power supply. Since at that time the first swing member 24 does not swing, and hence the swing contact plate 18 is kept stationary and grounded, electric current flows from the fixed contact 17*h* through the swing contact plate 19, the fulcrum electrode 17*d*, the window motor M, the fulcrum electrode 17*c*, the swing contact plate 18 to the fixed contact 17*f* (grounded) to thereby rotate the window motor M reversely, for example, and lower the window glass.

To the contrary when the knob 21 is swung counterclockwise (that is, to the up-side) as shown in FIG. 7(*b*), only the swing contact plate 18 is inclined reversely so that the direction of flow of electric current is reversed to rotate the window motor M forward, for example, and raise the window glass.

Figure 8:
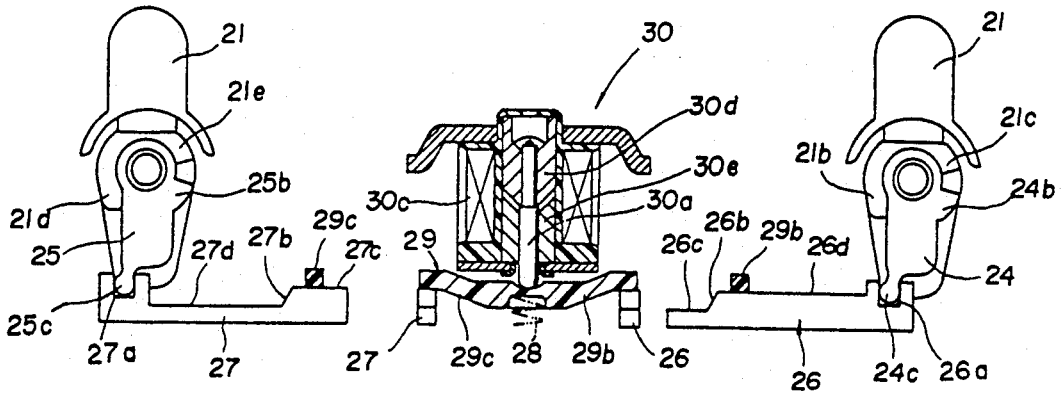

Next, the locking means for retaining auto-condition will be described As shown in FIGS. 4 and 8, the joint portions 24*c* and 25*c* formed at the leading ends of the first and second swing members 24 and 25, respectively, are engaged with engaging recesses 26*a* and 27*a* formed at one end of a pair of sliding members 26 and 27, respectively, located in parallel with each other. The joint portions 24*c* and 25*c* are linearly movable in interlocked relationship with the swing members 24 and 25, respectively. The amount of movement of the joint portions 24*c* and 25*c* correspond to the angle of swing of the swing members 24 and 25, respectively. Further, the sliding members 26 and 27 are located outside of the swing contact plates 18 and 19, respectively.

Formed on the other end side of the sliding member 26 is a forwardly inclined slope 26*b*, followed by a low step 26*c* which extends continuously therefrom. Reference numeral 26*d* denotes a higher intermediate step having a height $t_2$ against the height $t_1$ of the low step 26*c* ($t_1 < t_2$).

On the other hand, formed on the other end side of the sliding member 27 is a slope 27*b* followed by a high step 27*c* which extends continuously therefrom. Reference numeral 27*d* denotes a lower step whose height is $t_1$ against the height $t_2$ of the high step 27*c*.

The sliding members 26 and 27 are slidably fitted in grooves 16*h* and 16*i*, respectively which are formed in parallel with each other on the bottom corners of the vertical wall 16 on the base plate 10 (FIGS. 3 and 5) so as to extend from the chamber "A" to the chamber "B". The steps 26*c* and 27*c* of the sliding member 26 and 27, respectively, extend into the chamber B.

A recess 16*j* is formed in the central bottom portion of the chamber B, and upstanding terminals 17*i* and 17*j* which are connected with the electrode plates 17*a* and 17*b* (FIG. 5), respectively are provided near the recess 16*j*. Guide portions 16*k* and 16*l*, each of which is comprised of a pair of guide members, are provided at the left and right symmetrical positions relative to the recess 16*j* so as to stand upright in opposed relationship. One end of a coiled spring 28 is fitted in the recess 16*j*, and the other end thereof bears against the lower surface of a boss 29*a* of a locking arm 29. A solenoid 30 is arranged to bear against the upper surface of the boss 29*a*.

The locking arm 29*a* is comprised of the boss 29, and arms 29*b* and 29*c* formed integrally with the boss 29*a* so as to extend in opposite directions on both sides thereof. The arms 29*b* and 29*c* are supportably guided by the guide portions 16*k* and 16*l*, respectively, in such a condition as they are put between the pair of guide members of the guide portions 16*k* and 16*l*, so that they can be moved up and down by the coiled spring 28 and the solenoid 30, respectively. Further, the leading ends of the arms 29*b* and 29*c* are located at right angles to the sliding members 26 and 27, respectively, and are selectively engageable with either one of the steps 26*c* and 27*d*.

While, the solenoid 30 is located above the locking arm 29, and the leading end of a shaft 30*a* which extends through the solenoid 30 so as to be projected and retracted freely is fitted in a spherical recess formed in the boss 29*a* of the locking arm 29. Therefore, the locking arm 29 is pushed at its central portion downward by the solenoid 30 and upward by the coiled spring 28, and can be swung up or down when either one of the leading ends of the arms 29*b*, 29*c* which engages with the sliding member 26 or the sliding member 27 serves as a point of application of force, and the other leading end serves as a fulcrum for swinging. Both the leading ends of the arms 29*b*, 29*c* which serve alternately as a point of application of force and a fulcrum for swinging and the central boss 29*a* which is pushed by the solenoid 30 are located substantially collinealy.

Further, reference numeral 30*b* denotes a casing, 30*a* solenoid coil, 30*d* a movable iron core, 30*e* a fixed iron core, 30*f* engaging pawls formed on the upper part of the solenoid 30 and adapted to be engaged with the holes 16*e*, and 30*g* terminal lead wires of the coil 30*c* which are connected with the terminals 17*i* and 17*j*, respectively.

Next, a method of operation of this driver switch will be described mainly with reference to FIGS. 8 to 10. Incidentally, these figures are operational explanatory views of locking means showing the cross-section of the solenoid 30 taken in the longitudinal direction of the locking arm 29 and developed view of the sliding members 26 and 27 located symmetrically on both sides of the solenoid 30 together with the operating knob 21 and the swing members 24 and 25. Out of these figures, FIG. 8 shows the neutral condition wherein the coil 30*c* is not engaged yet and the locking arm 29 is in a horizontal condition. That is, the ends of the arms 29*b* and 29*c* are located on the high step 26*d* of the sliding member 26 and the high step 27*c* of the sliding member 27, which are located at the same height. ($t_2$ in FIG. 4)

Figure 9:
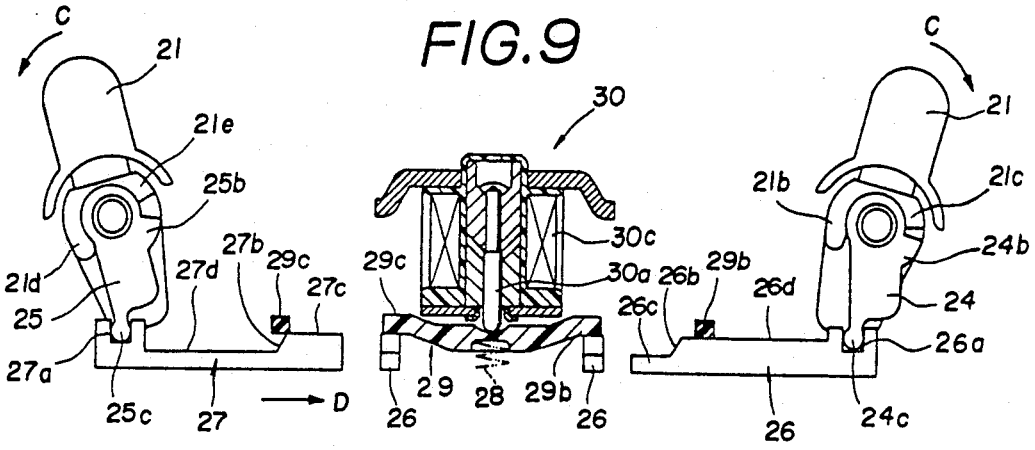

When the knob 21 is turned in a down-direction shown by arrow C in FIG. 9, for example, the switch will assume a manual-down position. Then, the second swing member 25 is engaged with the engaging portion 21*d* of the knob 21 and swung integrally or together therewith, while, the first swing member 24 is not engaged with the engaging portion 21*b* of the knob 21, and hence is maintained in the neutral condition. As a result, as shown in FIG. 7(*c*), only the second swing contact plate is pushed by the pin 25*e* and inclined reversely so that the normally-open contact 19*b* (refer to FIG. 6(*b*)) is brought into contact with the fixed contact 17*h* on the power supply side, and the switch will assume the manual-down position. Consequently, electric current will flow in such a direction as to rotate the window motor M reversely, and consequently upon the start of the window motor M, the solenoid 30 is energized by the auto-condition retaining circuit which will be described later.

At that time, the sliding member 27 whose engaging recess 27*a* is engaged with the joint portion 25*c* is slidably moved in a direction shown by arrow D in FIG. 9. At the same time, the solenoid 30 is excited so that the movable iron core 30*d* is attracted to the fixed iron core 30*e* by the magnetic force, thus tending to push the shaft 30*a* down to thereby push the locking arm 29 down. However, the arms 29*b* and 29*c* are located on the high step 26*d* of the sliding member 26 and the high step 27*c* of the sliding member 27, respectively, and in this condition, because the arm 29*c* is still located on the high step 27*c* of the sliding member 27, it cannot be locked. Since the arms 29*b* and 29*c* are not permitted to drop onto the low step 26*c* of the sliding member 26 and the low step 27*d* of the sliding member 27, respectively. Either of the arms 29*b* and 29*c* which is engageable with the sliding members 26 and 27 are allowed to slidably move in the direction opposite to that shown by arrow D, that is, in the direction of return.

If the operator leaves his hand from the knob 21 when the window glass has been lowered by a predetermined amount, then the knob 21 is returned to its neutral position (bent portion 16*g*) as shown in FIG. 5 by the reaction force from the sloping guide 16*f* against the resilient force of the spring 22 depressing the pin 23. Since, at the same time, the second swing member 25 is also disengaged from the engaging portion 21*d* of the knob 21, and also in FIG. 7(*c*) a returning force of the second swing member 25 is generated by the reaction force from the second swing contact plate 19 against the force of the spring 25*d* urging the pin 25*e* in pressure contact with the second swing contact plate 19, the second swing member 25 is also returned to its neutral position as shown in FIG. 8. Simultaneously therewith, the second swing contact plate 19 is also returned to its normal condition (the condition shown in FIG. 7(*a*)), and consequently the switch circuit is broken, thereby stopping the rotation of the window motor M.

Figure 10:
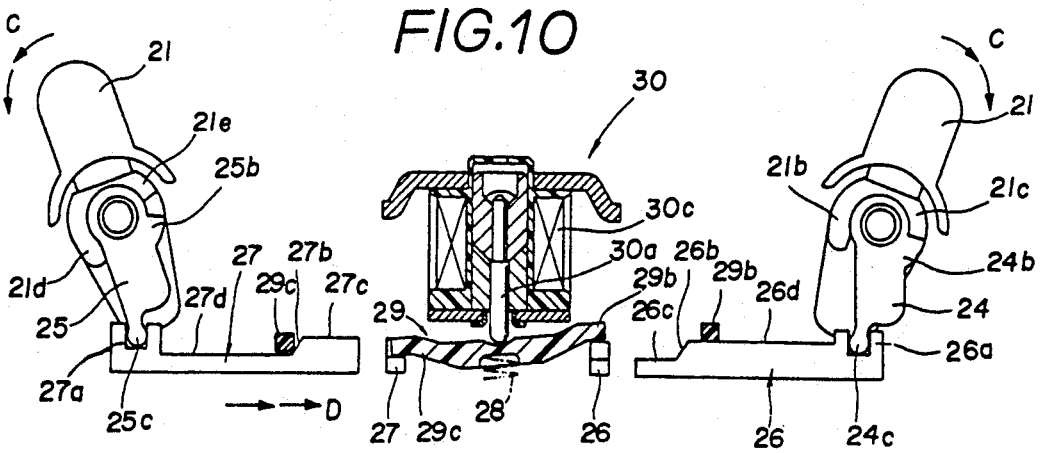

Next, when the knob 21 is further turned from the manual-down position in the down- direction (shown by double arrow C), the knob 21 is located at its auto-down position as shown in FIG. 10, auto-down retaining condition is reached wherein the sliding member 27 is located by the arm 29*c* of the locking arm 29.

That is, when the second swing member 25 is turned further with the turning of the knob 21, the sliding member 27 is also moved further in the direction shown by arrow D with the result that the slope 27*b* is allowed to pass under the arm 29*c*. Whereupon, the locking arm 29 is pushed down by the shaft 30*a* of the solenoid 30 so that the arm 29*c* is swung down against the resilient force of the coiled spring 28 to drop into the low step 27*d*, with the end of the arm 29*b* located on the sliding member 26 serving as a fulcrum for spring. Consequently, the leading end of the arm 29*c* serves as a point of application of force and is engaged with the slope 27*b* formed between the steps 27*c* and 27*d*, thus locking the sliding member 27 so as to prevent it from returning to its neutral condition. The sliding member 27 is kept in this locked condition while the solenoid 30 is energized or excited.

Figure 11:
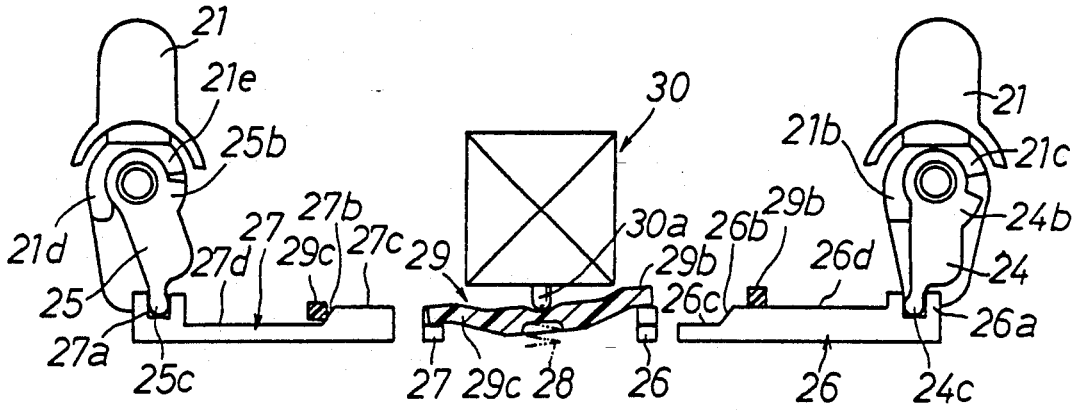

When the operator's finger is removed from the knob 21 in this condition, only the knob 21 is returned alone to the neutral condition as shown in FIG. 11 by the reaction force from the sloping guide 16*f* against the force of the spring 22 urging the pin 23 down, since the engaging portion 21*d* is disengaged from the second swing member 25 when the knob 21 is returned to its neutral position. Since the second swing member 25 is maintained in the swinging condition by the locked sliding member 27, the second swing contact plate 19 is inclined reversely to allow the window motor M to rotate continuously, thereby lowering the window glass continuously. At that time, the clearance between the releasing portion 21*e* and the stopper portion remains unchanged, and therefore they are not brought into contact with each other. Further, since the knob 21 and the second swing member 25 (first swing member 24) are provided with individual returning means, independent return of the knob 21 in the auto-condition can be achieved.

With regard to the first swing member 24 in the conditions as shown in FIGS. 8 to 11, the first swing member 24 is disengaged from the engaging portion 21*b* in each stage, and the releasing portion 21*c* is not brought into contact with the stopper portion 24*b*. Further even in the auto-down condition, the releasing portion 21*c* is not permitted to push the stopper portion 24*b*. Therefore, both the first swing member 24 and the sliding member 26 remain stationary.

When the window glass has been moved by a predetermined amount (to a fully-open position, for example) and the rotation of the window motor M is stopped, the supply of electric current to the solenoid 30 is cut off by the auto-condition retaining circuit which will be mentioned later, so that the locking arm 29 and the shaft 30*a* are pushed upward by the resilient force of the spring 28 to unlock the sliding member 27. Then, since the second swing member 25 is given a returning force to its neutral position by the reaction force from the second swing contact plate 19 against the force of the spring 25*d* depressing the pin 25*e* on the slope of the plate 19 in the condition shown in FIG. 7(*c*), the second swing member 25 becomes swingable and returns to its neutral condition in FIG. 8 while moving the sliding member 27 to its neutral position. Stating in brief, the force required for returning the sliding member 27 to its neutral position is afforded by the returning force of the second swing member 25, and therefore there is no need for provision of an independent returning means for the sliding member 27, and therefore the construction of the switch can be simplified. Incidentally, the force for returning the sliding member 26 to its neutral position is given by returning force of the first swing member 24 in the same manner.

If the knob 21 is swung in the direction reverse to the down-direction C or to the up-side in the condition shown in FIG. 8 then the first swing member 24 and the sliding member 26 are actuated instead of the second swing member 25 and the sliding member 27 so as to rotate the window motor M forward to move the window glass upward. However, the diagrammatic illustration thereof is omitted herein.

Further, since the locking arm 29 is arranged such that the leading ends of the arms 29*b* and 29*c* which are left and right hand points of the application of force, and the portion of the central boss 29*a* adapted to be depressed by the shaft 30*a* of the solenoid 30 are located substantially collinearly, loss of the force created by the solenoid 30 when energized can be reduced. As a result, the solenoid 30 can be made in smaller size and compact, resulting in reduction in the power consumption thereof and also the amount of shake of the locking arm 29 during its swing can be reduced, thereby enhancing the accuracy of engagement thereof and minimizing the influence of the shake on the positional accuracy of the solenoid 30 thus ensuring locking of either one of the sliding members 26 and 27.

Further, since the locking arm 29 is supported by the guide portions 16*k* and 16*l* during its swing, the amount of shake of the locking arm 29 can be reduced in this respect too. Moreover, since the locking arm 29 is located at right angles to the sliding members 26 and 27, the latter can be locked by both ends of one piece of locking arm 29, and also as compared to the case where locking is made by a locking arm located in parallel with or obliquely to the sliding members 26 and 27, locking can be made with certainty even if the locking arm shakes. Still further, since the locking arm 29 is constructed such that its central part is depressed by the shaft 30*a* of the solenoid 30, it is only enough to provide one piece of locking arm 29 and one piece of solenoid 30, which is advantageous in terms of the simplification of the structure of the switch.

Moreover, because of the provision of the sliding members 26 and 27 outside of the swing contact plates 18 and 19, respectively, the spacing between the swing contact plates 18 and 19 can be reduced and the transverse width of the swinging portion comprised of the knob 21 and the first and second swing members 24 and 25 can be reduced correspondingly so that the whole of the switch can be made more compact. Further, since the sliding members 26 and 27 are formed with high and low steps 26*c*, 26*d* and 27*c* and 27*d*, respectively, the arms 29*b* and 29*c* can be engaged with the sliding members 26 and 27, respectively, from above and in the direction at right angles to the direction of movement of the sliding members 26 and 27.

Furthermore, since in this embodiment the high and low steps of the sliding member 26 are in reverse positional relationship with that of the sliding member 27 so that the sliding member 26 is locked by the locking arm 29 when it is moved backward relative to the latter, while the sliding member 27 is locked by the locking arm 29 when it is moved forward relative to the latter, both the sliding members 26 and 27 can be located in parallel with each other so as to extend towards only one piece of locking arm 29 so that they can be locked by only one piece of locking arm 29.

Figure 12:
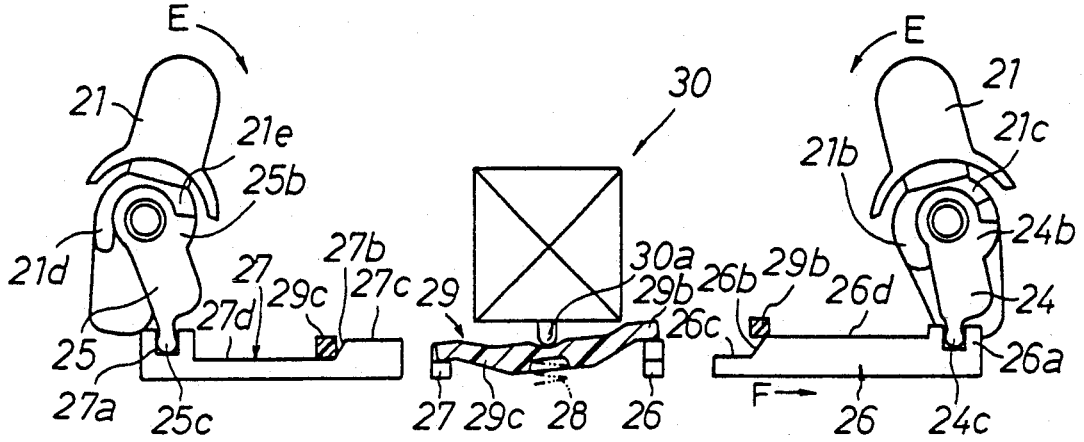
Figure 13:
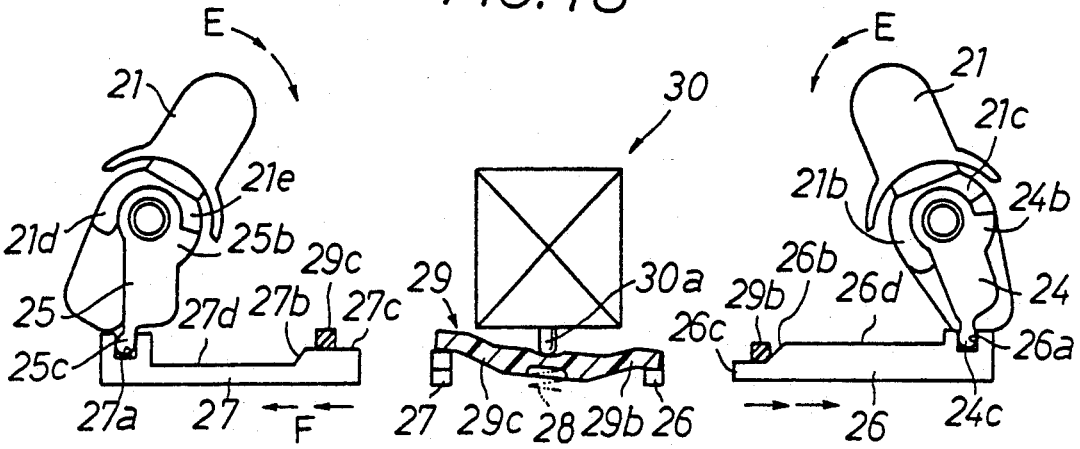

Further, FIG. 12 shows a condition wherein the knob 21 is operated from the neutral condition shown in FIG. 11 to the reverse manual position (manual-up position), and FIG. 13 shows a condition when the knob 21 is operated further to the reverse auto-position (auto-up position). These operations will be described in detail later.

Figure 14:
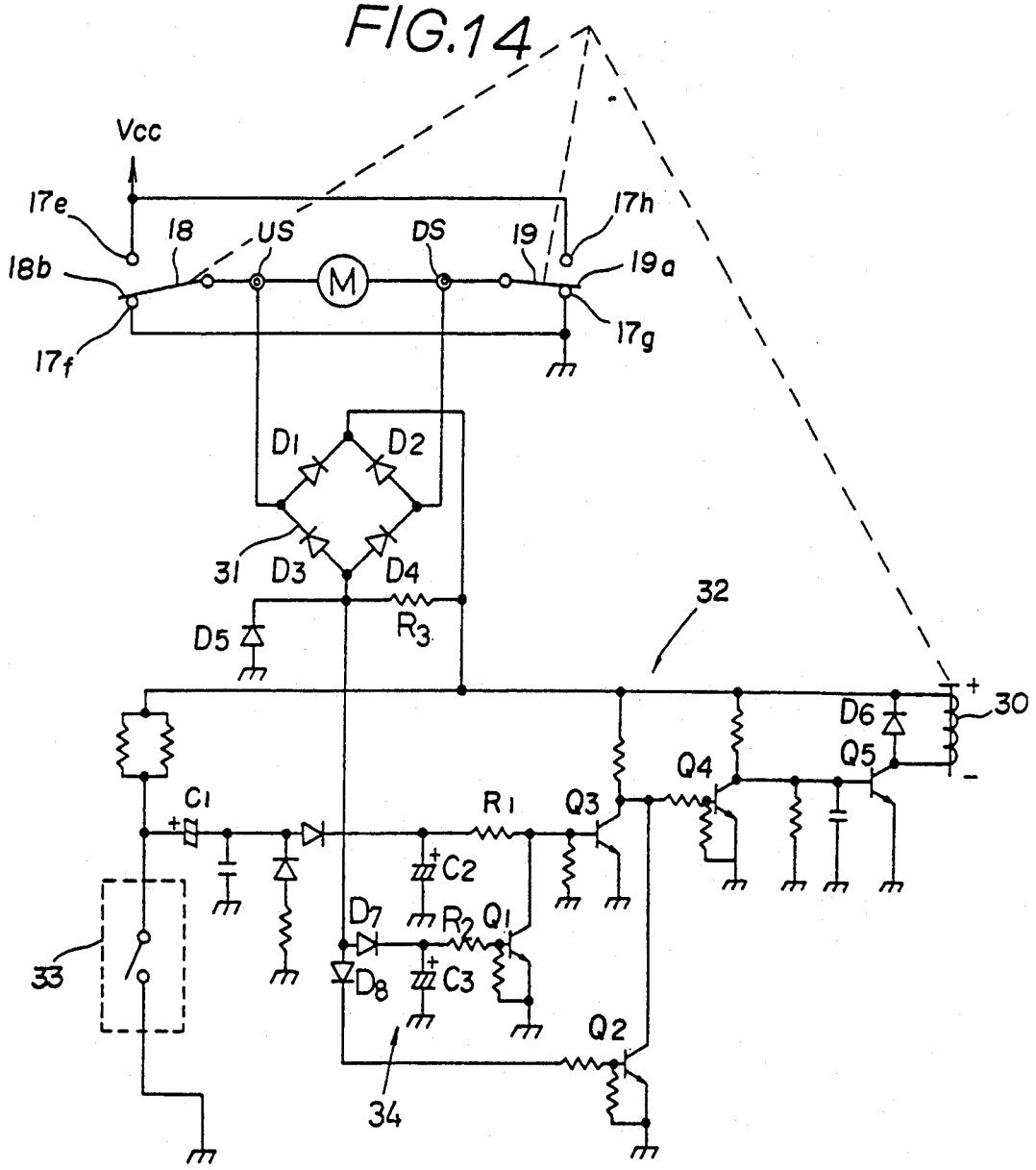

Next, one example of the circuit of this switch is shown in FIG. 14. This circuit comprises a diode bridge circuit 31 comprised of diodes $D_1$, $D_2$, $D_3$ and $D_4$ which are connected with the US and DS terminals of the window motor M, an auto-condition retaining circuit 32, and an optional auto-condition release circuit 34 which connects the diode bridge circuit 31 with the auto-condition retaining circuit 32. The optional auto-condition release circuit 34 also serves to prevent the window motor from reverse rotation which arises from optional auto-condition release.

In the diode bridge circuit 31, the cathode of the diode $D_1$ is connected with that of the diode $D_2$, the anode of the diode $D_3$ is connected with that of the diode $D_4$, the anode of the diode $D_1$ is connected with the cathode of the diode $D_3$, and the anode of the diode $D_2$ is connected with the cathode of the diode $D_4$.

A cathode common of the diodes $D_1$ and $D_2$ is connected with the auto-condition retaining circuit 32, and an anode common of the diodes $D_3$ and $D_4$ is connected with the optional auto-condition release circuit 34. The US terminal of the window motor M is connected with the junction between the diodes $D_1$ and $D_3$, and the DS terminal of the window motor M is connected with the junction between the diodes $D_2$ and $D_4$. Further, the cathode common of the diodes $D_1$ and $D_2$ is connected through a resistance R3 with the anode common of the diodes $D_3$ and $D_4$. The anode common of diodes $D_3$ and $D_4$ is connected through an anode common of the diodes $D_7$ and $D_8$ constituting the optional auto-condition release circuit 34 with transistors $Q_1$ and $Q_2$ in parallel, and is also connected with the cathode of diode $D_5$. The anode of diode $D_5$ is grounded.

The auto-condition retaining circuit 32 further comprises a solenoid 30 and a rotation sensor 33 which are connected with the cathodes of diodes $D_1$ and $D_2$, respectively.

Transistors $Q_3$, $Q_4$ and $Q_5$ are connected through capacitors $C_1$ and $C_2$ with the junction between the rotation sensor 33 and the solenoid 30. The base of the transistor $Q_3$ is connected with the collector of the transistor $Q_1$, and the base of the transistor $Q_4$ is connected with the collector of the transistor $Q_2$. Further, a capacitor $C_3$ is connected with the base of the transistor $Q_1$.

The solenoid 30 is energized when the transistor $Q_5$ is turned on. Further, a diode $D_6$ connected in parallel with the solenoid 30 serves to absorb a surge which occurs when the solenoid 30 is energized and deenergized, thereby protecting the transistor Q5.

When the knob 21 of the driver switch $S_1$ is swung, for example, to the down side as shown in FIG. 7(*c*), the movable contact 19*b* of the second swing contract plate 19 is connected with the fixed contact 17*h* which is connected with the power supply so that electric current is supplied to the window motor M, thereby rotating the latter. In this condition, as shown in FIG. 14, the rotation sensor 33 which is rotated by the rotation of the window motor M is repeatedly turned on and off. Consequently, the capacitor $C_1$ is repeatedly charged and discharged with the turn-on and turn-off of the rotation sensor 33 with the result that the capacitor $C_2$ is also charged and discharged (the capacitor $C_2$ is discharged at a time constant which is decided by the resistance $R_1$ when the capacitor $C_1$ is dischanged), that is a so-called pumping action will occur. As a result, when the capacitor $C_2$ is charged, the base of the transistor $Q_3$ is biased, thus turning it on, and the transistor $Q_3$ is held in the on-state provided that the number of revolutions of the rotation sensor 33 is a predetermined value or more.

When the transistor $Q_3$ becomes the on-state, the transistor $Q_4$ is turned off, and the transistor $Q_5$ is turned on, thereby rendering the solenoid 30 operative.

If the knob 21 is swung further to the auto-down position as shown in FIG. 10, then the sliding member 27 is locked by the locking arm 29 so that the connection of the fixed contact 17*h* with the movable contact 19*b* as shown in FIG. 7(*c*) is maintained and the switch will assume the aforementioned auto-position retaining condition.

Further, if in the condition shown in FIG. 14 either one of the swing contact plates 18 and 19 is connected with the power supply side, for example the second swing contact plate 19 is connected with the fixed contact 17*h*, then electric current flowing from the $D_s$ terminal to the diode bridge circuit 31 will flow through the diode $D_2$, the resistance $R_3$, the diode $D_3$, the $U_s$ terminal, the swing contact plate 18, the fixed contact 17*f* to the ground so that the transistors $Q_1$ and $Q_2$ are not biased, and so kept in an off-state.

After that, when the window glass reaches its lowermost position and the window motor M ceases its rotation, the number of revolutions of the rotation sensor 33 is reduced and the discharge time of the capacitor $C_1$ is increased to permit the capacitor $C_2$ to complete discharging after a predetermined delay time (0.2±0.07 second, for example) which depends on the time constant decided by the capacitor $C_2$ and the resistance R1. As a result, the potential of the base of the transistor $Q_3$ drops to turn it off, so that the transistor $Q_4$ is turned on and the transistor $Q_5$ is turned off, thereby deenergizing the solenoid 30.

As a result, in FIG. 9 the sliding member 27 is unlocked and permitted to move backward (or in the opposite direction to that shown by arrow D) so that the second swing member 25 is returned to its neutral position, thus returning to the neutral condition shown in FIG. 8. As a result as shown in FIG. 7(*a*), the second swing contact plate 19 is inclined so as to return to its original position to thereby disconnect the movable contact 19*b* from the fixed contact 17*h* which is connected with the power supply, thus releasing the auto-position retaining condition.

By providing the capacitor circuit which comprises the rotation sensor 33 which is interlocked with the window motor M and the capacitors $C_1$ and $C_2$, and the transistor circuit which comprises the transistors $Q_1$, $Q_2$ and $Q_3$, as mentioned above, the auto-condition retaining circuit 32 is capable of detecting the stopping of rotation of the window motor M and releasing the auto-position retaining condition. Therefore, unlike from the prior art example, the risk of the window glass being stopped by changes in electric current during its upward or downward movement is reduced so that the window glass can be opened or shut fully with certainty by the auto-operation.

Further, this embodiment has functions of releasing the auto-condition optionally or at any desired time, preventing the occurrence of unwanted reverse rotation of the window motor and compulsorily releasing the auto-position retaining condition.

The optional auto-condition release and unwanted reverse rotation preventing functions will be described. The optional auto-condition release function is to release the auto-position retaining condition at any desired time by turning the knob 21, which has previously been returned alone to its neutral position, for example, from the auto-down condition as shown in FIG. 11 to the reverse manual position (manual-up position) (FIG. 12). In addition thereto, in this embodiment, it is possible to prevent the occurrence of unwanted reverse rotation of the window motor M during the optional auto-condition releasing operation, that is, present the occurrence of possible slippage in the stop position of the window glass when the auto-position retaining condition is released.

Figure 15:
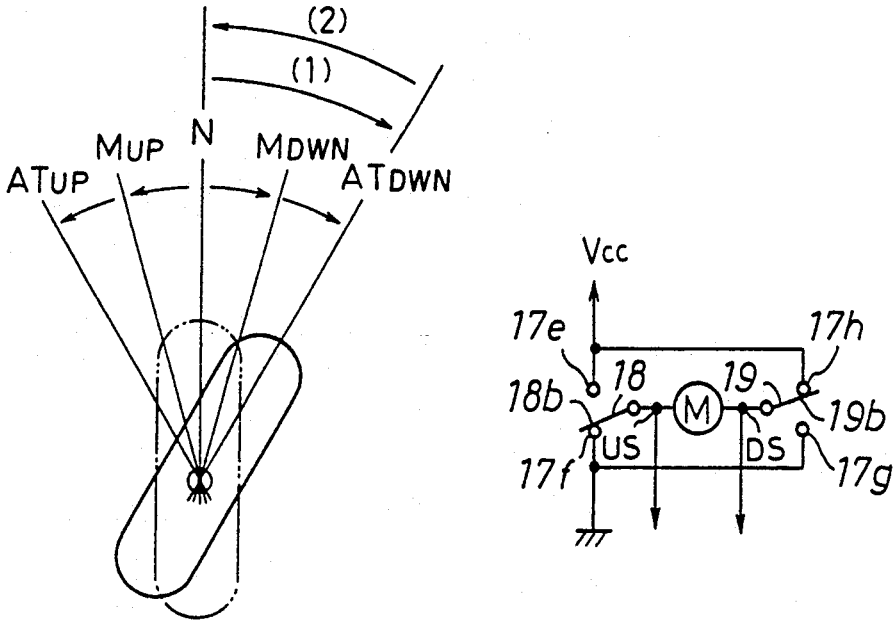
Figure 16:
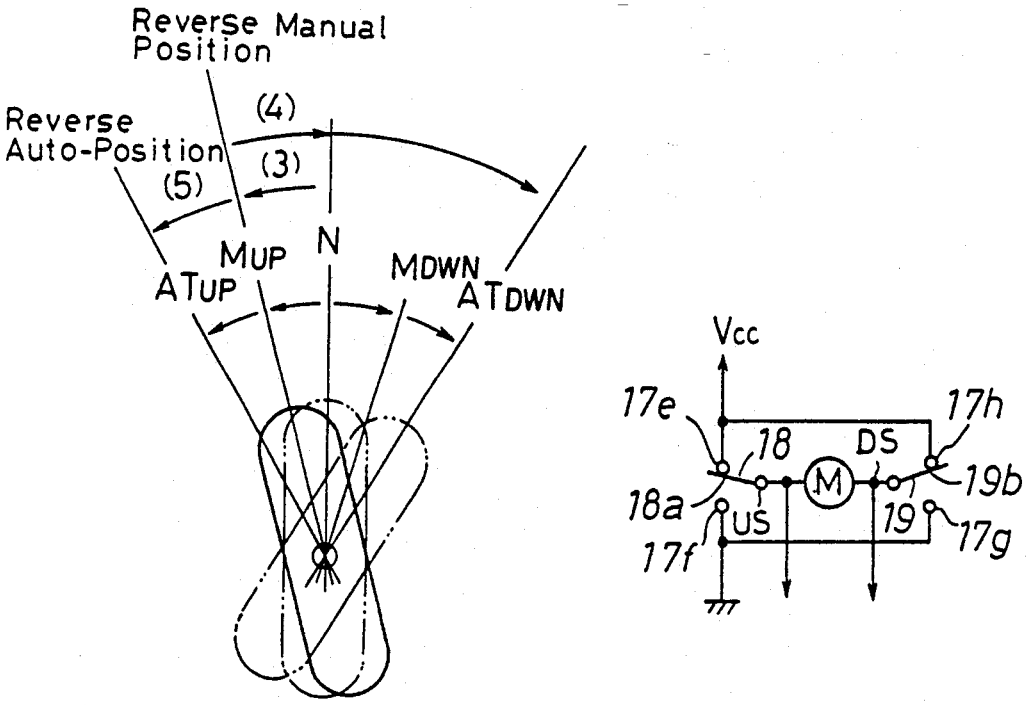
Figure 17:
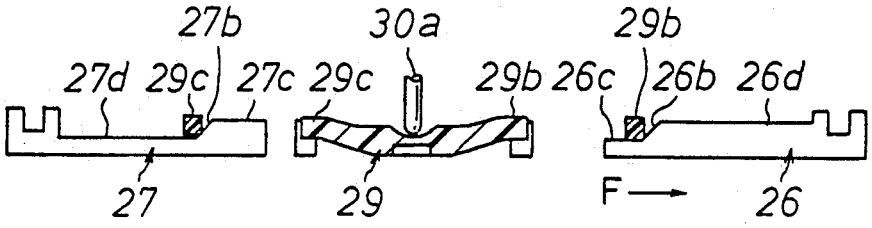
FIG. 17 is an explanatory view showing the operation of the locking means in case both sliding members are assumed to become auto-state simultaneously.

FIGS. 15 and 16 show schematically the operation of the knob after the contacts are allowed to assume the auto-down condition together with the condition of the contacts. FIG. 15 shows the contacts in the auto-down condition and the operation of the knob 21, while FIG. 16 shows the operation of the knob 21 to the up-side, i.e., the reverse manual position (manual-up position) or the reverse auto-position (auto-up position) together with the condition of the contacts. In case the second swing contact plate 19 is held mechanically in the auto-down condition as aforementioned and the knob 21 is returned to its neutral position N, as shown in FIGS. 11 and 15, the knob 21 is swung from 1(N−$M_{DWN}$−ATDWN) to 2($AT_{DWN}$−N), and the positional relationship between the sliding members 26 and 27 and the solenoid 30, etc., is as shown in FIG. 11. Hereupon, when the knob 21 is swung to the reverse manual position (or manual-up position $M_{UP}$) as shown by arrow 3 in FIG. 16, that is, in the direction shown by arrow E in FIG. 12, the swing contact plate 18 is inclined reversely so that the movable contact 18*a* is connected with the fixed contact 17*e* on the power supply side and both the terminals US and DS of the window motor M will assume Hi-Hi condition at the same time, that is, they have the same potential as the power supply. As a result, the rotation of the window motor M is stopped, and the window glass is stopped quickly and exactly at a desired position by the braking effect of the window motor M, thereby reducing the slippage in the stop position of the window glass due to its inertia.

Upon stoppage of the rotation of the window motor M because of the Hi-Hi condition, the rotation of the rotation sensor 33 is stopped to cease the application of a holding voltage to the transistor $Q_3$ to thereby turn the transistor $Q_3$ off. At the same time, all the cathodes and anodes of the diodes $D_1$, $D_2$, $D_3$ and $D_4$ of the diode bridge circuit 31 will have the same potential as the power supply and a signal voltage (which is referred to as "Hi-Hi condition" hereinbelow) is applied to the bases of the transistors $Q_1$ and $Q_2$ of the optional auto-condition release and unwanted reverse rotation prevention circuit 34. As a result, the transistor $Q_2$ is turned on immediately, and the transistor $Q_1$ is turned on after the capacitor $C_3$ has been charged.

Since the transistor $Q_4$ is turned off and the transistor $Q_5$ is turned on when the transistor $Q_2$ assumes on-state, the solenoid 30 is sustained in energized condition with the result that even when the transmission of sensor signal by the rotation sensor 33 is ceased the solenoid 30 is held in energized condition continuously. As a result, the second swing contact plate 19 remains to be held in the reversely inclined condition. FIG. 12 shows the positional relationship between the sliding members 26, 27 and the solenoid 30, etc. in this Hi-Hi condition. The sliding member 27 remains in the condition locked by the arm 29*c*.

If the knob 21 is returned to its neutral position N by operating it as shown by arrow 4 to return the swing contact plate 18 to the grounded side, then the Hi-Hi condition is released so that the transistors $Q_2$ and $Q_5$ are turned off to deenergize the solenoid 30, the second swing contact plate 19 is also released nearly at the same time as the first swing contact plate 18 and returned to the grounded condition, thereby releasing the auto-position retaining condition of the second swing contact plate 19. Since the transistor $Q_1$ assumes the on-state at that time, the capacitors $C_1$ and $C_2$ are discharged quickly, the influence of the charging by the sensor signal and the delay in operation of the circuit ($0.21 \pm 0.07$ seconds, for example) are eliminated so as to enable the second swing contact plate 19 to be grounded nearly at the same time as the first swing contact plate 18 is grounded.

Therefore, even in case the auto-switch is arranged such that both the manual and auto-operations can be conducted by means of a single operating knob and without using any relays, it has become possible to release the auto-condition at any desired time. As a result, the operability of the knob is enhanced and the whole of the auto-switch can be formed in a single, compact unit and the number of operations for mounting it on a door of a motor vehicle as well as the space for mounting it is reduced, thereby making it easier to mount it on the door and reducing the weight and cost thereof significantly.

Moreover, since the first and second swing contact plates 18 and 19 held in the Hi-Hi condition can be grounded nearly at the same time, unwanted reverse rotation of the window motor M which tends to occur when the auto-condition is released at any desired time can be prevented.

The occurrence of unwanted reverse rotation of the window motor during the optional auto-condition release operation is due to the fact that in case the switch is not provided with the diode bridge circuit 31 and the optional auto-condition release and unwanted reverse rotation prevention circuit 34 and the knob 21 is swung from the neutral condition N to the reverse manual position (manual-up position $M_{UP}$) in the direction shown by arrow 3 as shown in FIG. 16 to cause the switch to assume the Hi-Hi condition, thereby releasing the auto-condition at a desired time, then because the auto-condition retaining circuit 32 meets the auto-condition release conditions, if the first swing contact plate is delayed in returning to the grounded side and remains in Hi-condition when the second swing contact plate 19 is returned to the grounded side, then window motor M is caused to rotate reversely immediately to allow the window glass to commence upward movement thus making it difficult to stop the window motor M exactly at any desired position.

In this embodiment, however, it is possible to prevent the occurrence of such a trouble or event and stop the window glass exactly and surely at any desired position.

Further, even if this Hi-Hi condition is released, the transistor Q1 is biased for a predetermined time constant which is decided by the capacitor C3 and resistance $R_2$. Consequently, even after the transistor $Q_2$ is turned off, the transistor $Q_1$ sustains its on-state for a predetermined time (0.25–0.95 seconds, for example). In the auto-condition retaining circuit 32, only when the transistor $Q_3$ is in an on-state, the transistor $Q_3$ is turned off, the transistor $Q_4$ is turned off, and the transistor $Q_5$ is turned off, thereby energizing the solenoid 30. Thus, if the knob 21 is swung beyond the reverse manual position (manual-up position $M_{UP}$) to the reverse auto-position (auto-up position $AT_{UP}$) as shown by arrow 5, for example, in that period, it is possible to prevent the switch from being held in the auto-condition inadvertently. However, if the knob 21 is held at the auto-condition until the transistor $Q_1$ is turned off, then the switch is subsequently held in the auto-condition. This is applicable to the case where the knob 21 is operated to the auto-down position $AT_{DWN}$.

Therefore, even if the knob 21 is swung forcibly and excessively in releasing the auto-position retaining condition at any desired time, it is possible to prevent the switch from assuming the auto-position retaining condition which is not desired. Therefore, it is not necessary to take a lot of care during the operation of the knob 21, and so its operability is enhanced.

Next, the function of compulsorily releasing the auto-position retaining condition will be described. In case it is desired to release the knob 21 from the auto-position retaining condition at any desired time, if the knob 21 is swung by mistake to the reverse auto-position in the condition shown in FIG. 12, then because the solenoid 30 is energized in the Hi-Hi condition, the sliding member 26 is moved back further to drop the arm 29*b* onto the low step 26*c* to allow the sliding member 26 to assume the auto-position retaining condition, provided no measure is taken as shown in an assumed example in FIG. 17. As a result, both the sliding members 26 and 27 are held in the auto-position, and in this state the Hi-Hi condition is sustained, and as a result, it becomes impossible to release the auto-position retaining condition.

In this embodiment, in such an event, the sliding member which is retained in the auto-position previously (the sliding member 27 in case of this embodiment) is released compulsorily from the auto-position retaining condition. That is, if the knob 21 is swung to the reverse manual position in FIG. 12, the releasing portion 21*e* of the knob 21 is brought into contact with the stopper portion 25*b* since the second swing member 25 is in the auto-condition. If the knob 21 is swung further to the reverse auto-position (in the up-direction shown by arrow E), then the releasing portion 21*e* of the knob 21 pushes the stopper portion 25*b* to turn the second swing member 25 compulsorily in the clockwise direction in FIG. 12. As a result, the sliding member 27 is moved back strongly in the direction shown by arrow F to push the arm 29*c* along the slope 27*b* up onto the high step 27*c*, so that as shown in FIG. 13 the reverse auto-condition is reached wherein the arm 29*b* is dropped onto the low step 26*c* of the sliding member 26, and at the same time the sliding member 27 is unlocked from the arm 29*c*, thereby releasing the auto-down condition compulsorily. Thus, both the swing contact plates 18 and 19 can be prevented from being held in the Hi-Hi enable condition at the same time and becoming incapable of being released from the auto-condition, thereby ensuring that either one of the swing contact plates 18 and 19 is released compulsorily from the auto-condition.

Figure 18:
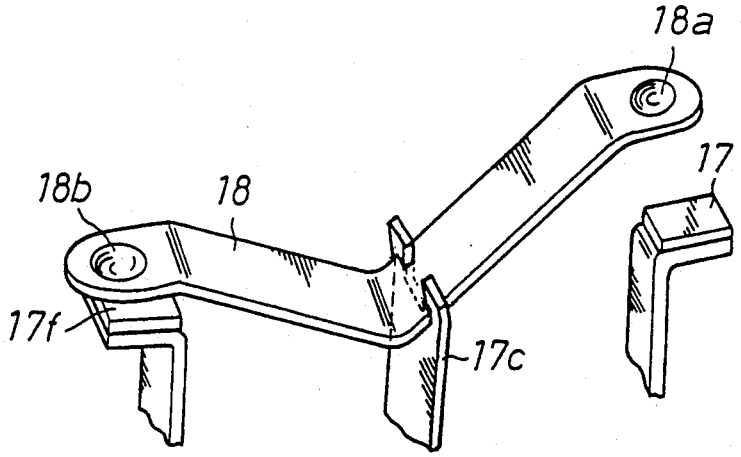
FIG. 18 is a perspective view of another embodiment of the swing contact plate.

FIG. 18 shows another embodiment which comprises a modified swing contact plate 18 and modified fixed contacts 17*e* and 17*f*. By bending the top of each of the fixed contacts 17*e* and 17*f* so as to enable either one of movable contacts 18*a* and 18*b* formed on both ends of the swing contact plate 18 to be brought into contact from above with the fixed contacts 17*e* and 17*f*, the accuracy of opening and closing of the contacts can be enhanced significantly. In this case, the second swing contact plate 19 and the fixed contacts 17*g* and 17*h* are of course formed in the same configuration.

Further, the parts of this embodiment having the same functions as those of the previous embodiment are denoted by the same reference numerals.

Moreover, the releasing portions 21*c* and 21*e* correspond to the first and second releasing portions respectively, in the present application, and the stopper portions 24*b* and 25*b* correspond to the first and second stopper portions, respectively, in the present application.

Figure 19:
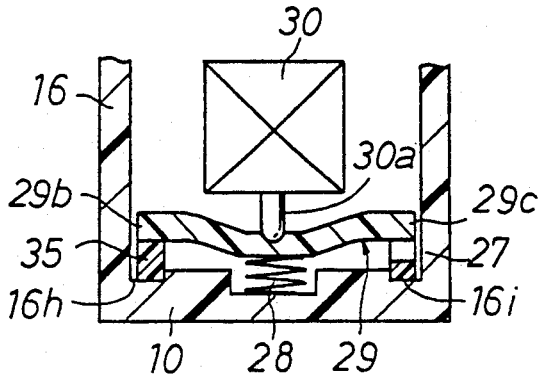
FIGS. 19 through 21 are schematic sectional views of other embodiments of locking means.
Figure 20:
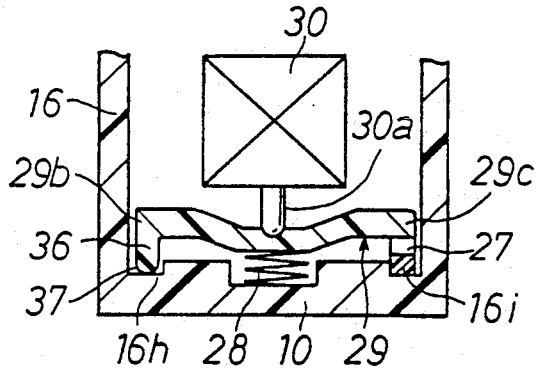
Figure 21:
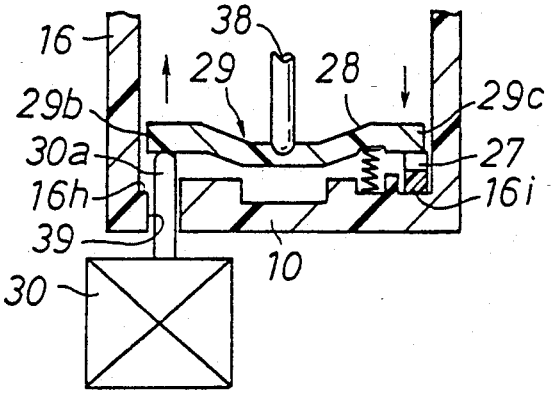
Figure 22:
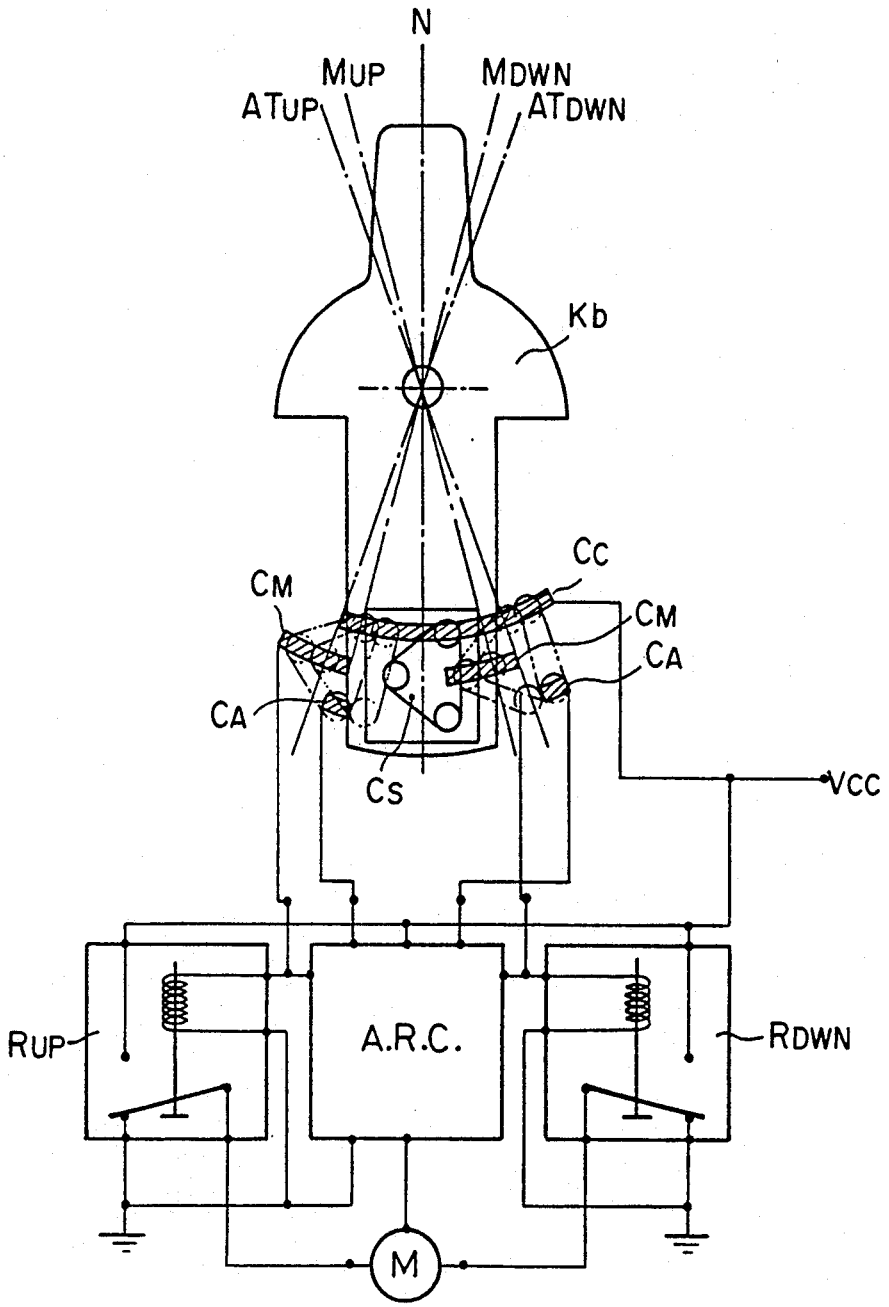
FIG.22 (Prior Art)
FIG. 22 is a circuit diagram of a prior art example.

FIGS. 19 to 21 show further embodiments wherein the auto-operation can be made only on the down-side, and a sliding member is provided only on one side thereof. Each of these embodiments is schematically illustrated in the section along the longitudinal direction of the locking arm.

In the embodiment shown in FIG. 19, to enable the base 10 to be used commonly with the previously mentioned embodiment, the vertical wall 16 of the base 10 has a pair of grooves 16*h* and 16*i* formed in parallel relationship on the bottom corners thereof. Only a down-side sliding member 27 is inserted in the groove 16*i*, and a support block 35 having the same height as that of the high step of the sliding member 27 is fitted in the groove 16*h*. The locking arm 29 is arranged such that locking can be made with the arm 29*b* carried on the support block 35 as a fulcrum for swinging and the arm 29*c* serving as a point of application of force carried on the sliding member 27. In the same manner as the previous embodiment, the arrangement is made such that the central part of the locking arm 29 can be depressed by the shaft 30*a* of only one piece of the solenoid 30 and the opposite side of the locking arm 29 is biased upward by the coiled spring 28. By so doing, the sliding member 27 can be locked only on the side of arm 29*c*, and also upon modification of the design specification it is only necessary to fit the support block 35 in the groove in place of sliding the arm on the up-side. Therefore, almost all the component parts of the switch can be used in common with the design specification which enables both auto-up and auto-down operations to be conducted, and so the design specification can be changed very easily. Therefore, this embodiment is economical.

FIG. 20 shows an embodiment similar to that shown in FIG. 19 and uses a modified locking arm 29. On the up-side, there is provided a fulcrum member 36 formed integrally with one end portion of the locking arm 29 and which is curved so as to fit in the groove 16*h*. The fulcrum member 36 is accommodated in the groove 16*h*, and the curved portion formed on the leading end thereof is brought into contact with the bottom surface of the groove 16*h* and serves as the fulcrum for swinging. By virtue of such an arrangement, there is no need for manufacturing the fulcrum member 36 used in the previously mentioned embodiment separately as an independent component part, so that the number of parts can be reduced when compared with that of the previously mentioned embodiment.

The embodiment shown in FIG. 21 is arranged such that the central part of a locking arm 29 is biased upwardly from below and supported by a coiled spring 28, and the portion of the locking arm 29 on the opposite side of the point which is urged upward by the coiled spring 28 is supported by a stopper member 38. The stopper member 38 is provided at a position where it can be brought into contact with the arm 29*c* at such a height as the arm 29*c* is disengaged from the sliding member 27. Further, a groove 16*h* formed below the arm 29*b* has a through-hole 39 formed therein, and a shaft 30*a* of a solenoid 30 mounted below the base 10 is projected through the through-hole 39 inside of the vertical wall 16 so as to contact and support the arm 29*b*. In such an arrangement, by extending the shaft 30*a* upwardly to push the arm 29*b* up, the arm 29*c* can be swung down and engaged with the sliding member 27, since the central part of the locking arm 29 is supported by the stopper member 38. Further, when the shaft 30*a* is moved back or down, the locking arm 29 is returned to its original parallel condition, thereby unlocking the sliding member 27. Therefore, in this embodiment too, the locking arm 29 and the sliding member 27 can be used in common with the design specification which enables both auto-up and auto-down operations to be conducted. Moreover, since the solenoid 30 is mounted under the base 10, this structure is extremely convenient to the case where there is a constraint on design which makes it difficult to mount the solenoid above the base 10.

What is claimed is:

1. An auto-switch for use in a power window comprising:

an operating knob supported by a shaft so as to swing freely, said operating knob to change over a window motor between forward rotation and reverse rotation depending on a direction of swing of the operating knob from a neutral position to enable a window to move down or up, the operating knob having clockwise and counter-clockwise located manual positions respectively, for rotating the window motor only while the operating knob is manually provided with an angle of swing within a predetermined value, and said operating knob also having an auto-position at least when pivoted clockwise for permitting the window motor to rotate continuously even if the operating knob is not manually pivoted when the angle of swing exceeds the predetermined value;

a first swing member and a second swing member supported coaxially on opposite sides of the operating knob in a direction of the shaft and which are swingable together with or separately from the operating knob;

engaging means for selectively engaging either one of the first and second swing members with the operating knob depending on a direction of swing thereof when the operating knob is swung either to one of the manual positions and the auto-position, and then swinging a selected swing member in a same direction as the operating knob, and thereafter enabling the operating knob to be returned alone to the neutral position, with a selected swing member left in a swinging condition;

a first swing contact plate and a second swing contact plate, each having a generally V-shape, and mounted in parallel with each other to enable each of the swing members during movement to be brought into sliding contact therewith, the first and second swing contact plates being inclined opposite to each other when the operating knob and each of the swing members are located at neutral positions, when either one of the swing members is engaged with and swing together with the operating knob during pivoting of the operating knob, only the swing contact plate, with which a sliding member engaged with the operating knob is brought into sliding contact, is inclined reversely;

a pair of fulcrum electrodes, each supporting an intermediate portion of each of the swing contact plates and being connected to each terminal of both poles of the window motor;

a normally-open movable contact and a normally-closed movable contact provided on both ends of each of the swing contact plates;

a first fixed contact located on a power supply side, said first fixed contact provided in opposed relationship to said normally-open movable contact of each swing contact plate and arranged to come into contact with the swing contact plate when a corresponding swing contact plate is inclined reversely;

a second fixed contact located on a ground side, said second fixed contact provided in opposed relationship to said normally closed movable contact of each swing contact plate;

locking means for mechanically holding the swing member in the swinging condition which is engaged with an swung together with the operating knobs by an engaging means when the operating knob is pivoted to the auto-position, the locking means comprising said sliding member connected to one of the swing members and slidably movable rectilinearly together with the swing member which is engaged therewith, a locking arm provided adjacent to said first and second swing contact plates, said locking arm extending in a direction at right angles to said sliding member and engageable with an engaging portion formed on the sliding member, a solenoid provided adjacent said operating knob, said solenoid for urging the locking arm in a direction to engage the locking arm with the sliding member, and a resilient member for biasing the locking arm in a direction to disengage the locking arm from the sliding member; and returning means for automatically returning the operating knob and each of the swing members from the swing positions to neutral positions, wherein during auto-operation, the normally-open movable contact of a corresponding swing contact plate is held mechanically in a closed condition.

2. An auto-switch for use in a power window according to claim 1, wherein the engaging means comprises a first engaging portion formed on a portion of the operating knob adjacent to the first swing member to engage only with the first swing member when the operating knob is pivoted, and a second engaging portion formed on the portion of the operating knob adjacent to the second swing member to engage only with the second swing member, said first and second engaging portions being formed on the opposite sides of the operating knob about the shaft and in symmetrical relationship to a vertical axis passing through a center of the operating knob at the neutral position, when the operating knob is pivoted, depending on the direction of pivot thereof, either one of the engaging means is engaged with and swung together with a corresponding swing member, while the other engaging portion remains in a disengaged condition from the corresponding swing member and when the operating knob is returned to the neutral position the swing member which is engaged and swung together with the engaging portion is disengaged therefrom, therein permitting the operating knob to pivot alone in a return direction.

3. An auto-switch for a power window comprising a window motor circuit which is composed of a manual/auto contact for supplying/cutting electric power to a window motor;

a solenoid which operates interlockingly with opening/closing action of said manual/auto contact;

an auto-position retaining circuit for retaining said solenoid at an excited state under an auto-state;

a rotation sensor circuit for supplying retaining voltage to said auto-position retaining circuit by means of a rotation sensor which rotates interlockingly with said window motor and generates pulses; and an AND circuit for retaining said auto-position retaining circuit in said auto-state when said manual/auto contact is actuated while in said auto-state.

4. An auto-switch for use in a power window according to claim 1, wherein said returning means of the operating knob and each of the first and second swing members are formed separately, a knob returning means of the operating knob being composed of a sloping guide of a generally V-shaped section formed on a base of a switch, and a first thrusting member provided on a leading end of the operating knob to be brought into pressure contact with the sloping guide and moved forward and backward freely, the first thrusting member being biased by a resilient member in a direction of projection, and a swing returning means of each of the first and second swing means being composed of a second thrusting member provided on a leading end thereof and having a similar shape so that of the operating knob, and a first swing contact plate and a second swing plate with which a corresponding thrusting member can be brought into pressure contact so that the operating knob and each of the swing members can be returned independently to respective neutral positions.

5. An auto-switch for use in a power window according to claim 1, wherein at least one locking means is provided an amount of movement of the sliding member being variable corresponding to the angle of swing of the operating knob and the swing member which is engaged with and swung together with the operating knob, when the operating knob is moved to the manual position, the engaging portion of the sliding member is moved to a position not engaged with the locking arm, and when the operating knob is moved to the auto-position, the engaging portion is moved to a position engaged with the locking arm, and when the operating knob is moved to the auto-position, the engaging portion being engaged with the locking arm depressed by the solenoid, therein holding the swing member, which is engaged with and swung together with the operating knob, is the swinging condition.

6. An auto-switch for use in a power window according to claim 5, wherein a force for returning the sliding member to the neutral position is provided by a returning swinging force of the swing member.

7. An auto-switch for use in a power window according to claim 6, wherein the locking arm is swingable up and down with one end thereof serving as a fulcrum for swinging, and another end thereof serving as a point of application of force which is engaged with the engaging portion of the sliding member, the fulcrum application point of force and pushing portion of the solenoid being arranged collinearly.

8. An auto-switch for use in a power window according to claim 7, wherein the locking arm is located between a pair of guide portions standing upright in parallel with each other in the direction of swing so that the swing thereof may be guided by the guide portions.

9. An auto-switch for use in a power window according to claim 6, wherein the engaging portion of the sliding member is comprised of a high step and a low step formed on the sliding member in a longitudinal direction thereof, when a leading end of the locking arm is dropped onto the low step, the locking arm is engaged with a slope between the high and low steps so as to prevent the sliding member from returning to the neutral position.

10. An auto-switch for use in a power window according to claim 9, wherein the sliding member is a pair of sliding members arranged in parallel with each other and connected to the first and second swing members, respectively.

11. An auto-switch for use in a power window according to claim 10, wherein the sliding members are located outside of the first and second swing members, respectively.

12. An auto-switch for use in a power window according to claim 10, wherein both ends of the locking arm are located to intersect the pair of sliding members, and a central portion of the locking arm is pushed by one piece of the solenoid.

13. An auto-switch for use in a power window according to claim 12, wherein the operating knob has a set of manual positions and a set of auto-positions for each of the clockwise and counter-clockwise positions, and further comprising a compulsory auto-condition release mechanism for compulsorily releasing an auto-condition of one of the swing members when the knob is swung to a reverse auto-position on an opposite side of the operating knob while said swing member is held in the auto-condition.

14. An auto-switch for use in a power window according to claim 13, wherein the compulsory auto-condition release mechanism comprises a pair of first and second releasing portions, each formed on each side of the operating knob on which the first and second swing members, respectively, are mounted, in such a way as to face reversely with each other, a second stopper portion formed on the second swing member to project therefrom to be engaged with the second releasing portion when the operating knob is swung to a reverse manual position in such a condition as the second swing member is held at an auto-down position and the operating knob and the first swing member are located at the neutral positions, therein swinging the first swing member to a manual-up position, and a first stopper portion formed on the first swing member to project therefrom to be engaged with the first releasing portion when the knob is swung to a reverse manual position with the first swing member held at an auto-up position and the operating knob and the second swing member located at the neutral positions, therein swinging the second swing member to a manual-down position, when either one of the first and second swing members is located at the auto-position, if the other swing member is swung clockwise or counter-clockwise by the operating knob from a reverse manual position to a reverse auto position located in the same direction of swing, then the swing member which is located at said auto-position is mechanically unlocked by the releasing portion which is engaged with the corresponding stopper portion and turned together with the operating knob.

* * * * *